US006467179B1

(12) United States Patent
Wolf

(10) Patent No.: US 6,467,179 B1
(45) Date of Patent: Oct. 22, 2002

(54) MEASURING AND DRAFTING TOOL

(76) Inventor: Sigrid Hammer Wolf, 23226 Bay Ave., Moreno Valley, CA (US) 92553

( * ) Notice: Subject to any disclaimer, the term of this patent is extended or adjusted under 35 U.S.C. 154(b) by 0 days.

(21) Appl. No.: 09/570,506

(22) Filed: May 13, 2000

(51) Int. Cl.[7] ..... B43L 7/027; B43L 7/10
(52) U.S. Cl. ..... 33/474; 33/465; 33/520
(58) Field of Search ..... 33/474, 27.01, 33/27.02, 27.03, 42, 451, 452, 465, 471, 476, 478, 520, 644, 562, 563, 666, 669, 670, 671

(56) References Cited

U.S. PATENT DOCUMENTS 765,300 A * 7/1904 Williams ..... 33/27.03
895,258 A * 8/1908 Grant ..... 33/465
1,118,067 A * 11/1914 Smith ..... 33/474
1,155,715 A * 10/1915 Faust ..... 33/474
1,307,233 A * 6/1919 Bernard ..... 33/27.03
1,373,367 A * 3/1921 Summers ..... 33/673
1,467,200 A * 9/1923 Sharpe ..... 33/574
1,545,424 A * 7/1925 Heimrich ..... 33/562
2,054,420 A * 9/1936 Hochman ..... 33/27.01
3,089,245 A * 5/1963 Cromer et al. ..... 33/27.03
3,371,420 A * 3/1968 Di Panr, Jr. ..... 33/562
5,090,129 A * 2/1992 Cunningham ..... 33/474
5,131,164 A * 7/1992 Miller ..... 33/451
5,539,991 A * 7/1996 Harrison ..... 33/42
6,070,331 A * 6/2000 Dempsey ..... 33/42

* cited by examiner

*Primary Examiner*—Christopher W. Fulton
(74) *Attorney, Agent, or Firm*—Robert N. Schlesinger

(57) ABSTRACT

This Measuring and Drafting Tool relates to a new and useful type of measuring and drafting tool that may be used to accomplish a plurality of functions using a singular tool. These functions include application as a ruler, straight edge, T-square, square or squaring tool, center gage, an edge transcribing and duplicating tool, and as a tool for striking circles and circle arcs. Some modified embodiments of the Measuring and Drafting Tool are also capable of angle measurement and protractor functions, and may also include one or more bubble levels incorporated into the ruler segments, thereby allowing the user to check if a horizontal surface is level.

15 Claims, 19 Drawing Sheets

MEASURING AND DRAFTING TOOL

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

This invention, entitled "measuring and Drafting Tool", was devised and invented by Sigrid Hammer Wolf, and relates to a new and useful type of measuring and drafting tool or instrument that may be used to accomplish a plurality of functions using a singular tool or instrument. These functions include, but are not limited to use as a ruler, straight edge, T-square, square or squaring instrument, center gage, an edge transcribing and duplicating tool, and as a tool for striking circles and circle arcs. Some modified embodiments of the Measuring and Drafting Tool are also capable of angle measurement and protractor functions. Some other modified embodiments may also have one or more levels incorporated therein, and may thereby be used for checking if a horizontal surface is level.

This "Measuring and Drafting Tool" will hereinafter be referred to as the "Measuring Tool", and as a proper noun with the first letter of each word capitalized, throughout this specification and its appended claims.

The term "tool" as used throughout this specification and its appended claims is intended to also refer to an instrument, implement, device, appliance, and the like.

The term "calibration" as used throughout this specification and its appended claims is also intended to refer to the calibration and enumeration of said calibration, on one or more ruler segment (1) elements of the Measuring Tool.

FIELD OF THE INVENTION

This Measuring Tool has applications in the drafting industry, as well as the education, construction, carpentry, fine arts, graphic arts, needlecraft and quilting, and crafts industries, where there is a need for a handy tool for quick and easy measuring of surfaces, as well as wooden beams, studs, panels, balsa, dowel rods, metals, plastics, veneers, foam core, paper, vellum, fabric, and the like. Said surfaces need not be continuous in a Euclidean plane or along a linear plane, but may be a curved surface or a branching surface or surface that is not straight. This Measuring Tool may be used for measuring a variety of materials, including but not limited to wood, paper, fabric, plastic, rubber, metal, and composite materials.

DESCRIPTION OF THE RELATED ART INCLUDING INFORMATION DISCLOSED UNDER 37 CFR 1.97 AND 1.98

Heretofore, when a construction worker, carpenter, dramatic set designer, draftsperson, craftsperson, or the like, needs to make a measurement or sketch-out a square, circle, or a portion thereof, such as an L or 90-degree, or an arc, the task would require the use of a plurality of instruments or would be a multi-step process, to get an accurate square or arc. Furthermore, the task of finding the origin or center point of a circle may not be a simple matter when one is in the field and has access to limited tools, and may be problematic.

The inventor, Sigrid Hammer Wolf, has devised and invented a new and useful type of measuring and drafting tool, that may more easily and conveniently be used to accomplish a variety of routine and specialized tasks, and without using a plurality of tools. The applications for this Measuring Tool include application as a ruler, a T-square, straight edge, and the Measuring Tool may be used to determine the origin or center point of a circle, and to sketch-out circles and arcs of varying diameter and length, respectively. Some modified embodiments of the Measuring Tool have a protractor (11) or the like, incorporated therein, and may thereby be used for angle measurement. Some other modified embodiments may also have one or more bubble levels (10) incorporated therein, and may thereby be used for checking if a horizontal surface is level.

BRIEF SUMMARY OF THE INVENTION

In trying to solve the above-described construction and craft industry problems and disadvantages, and within the scope of this objective, it was surprising to find that a solution to the above described problems and disadvantages in present measuring and drafting technology need not be expensive or involve complex technology, but did require considerable thought and design analysis of the Measuring Tool disclosed herein.

BRIEF DESCRIPTION OF THE SEVERAL VIEWS OF THE DRAWINGS

The drawing figures reflect the selected embodiments for the present Measuring Tool invention, and as intended for the construction, carpentry, craft, and drafting industries, but said invention is not limited to said use or applications, and may have further applications in other types of related industries, such as with educational institutions, the arts, and the advertising and sign manufacturing industry.

DESCRIPTION OF A SIMPLE EMBODIMENT OF THE MEASURING TOOL

Figure 1:
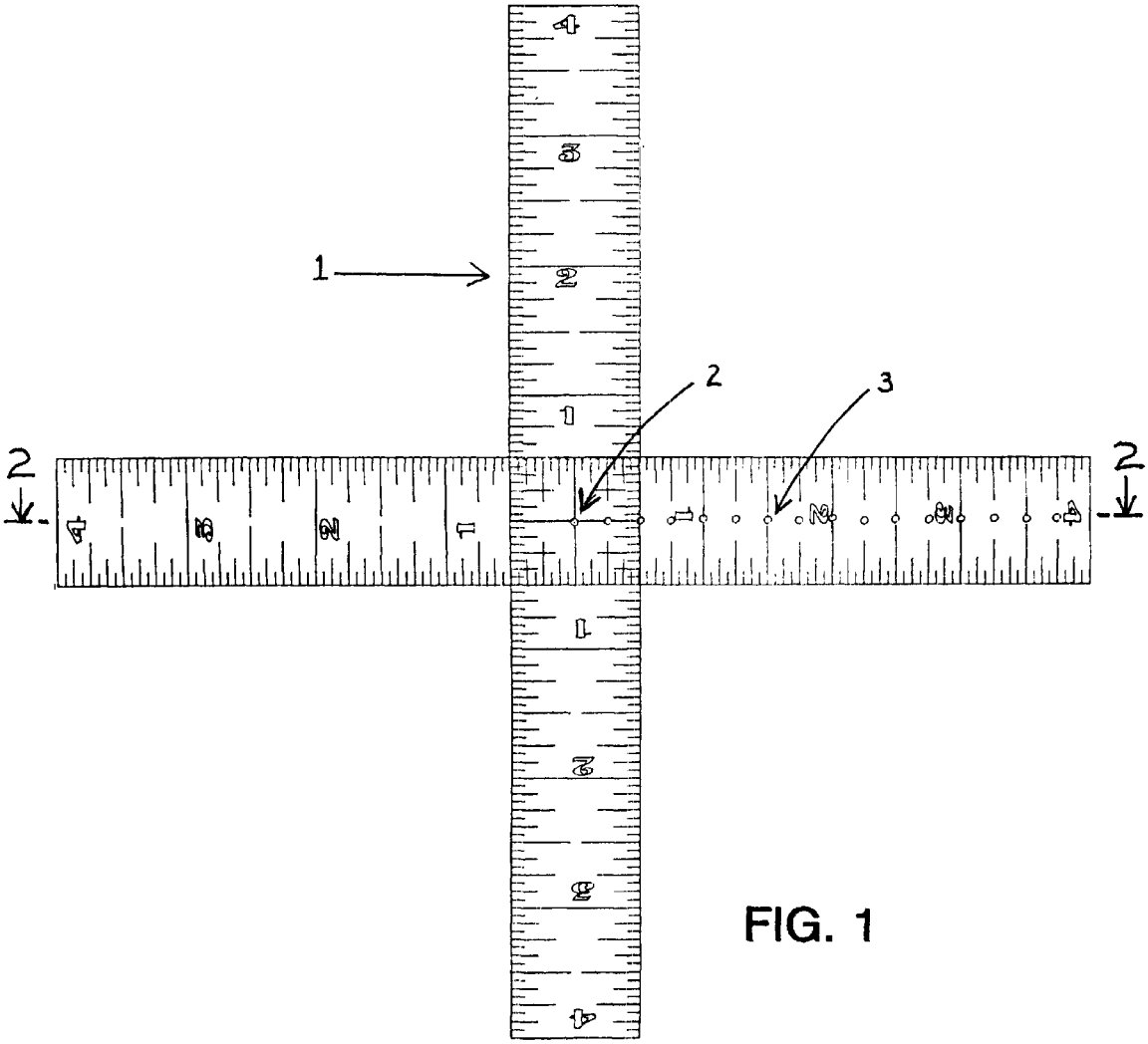
FIG. 1 shows a top view of a simple embodiment of the Measuring Tool, with guide holes (3) that may receive a pencil tip (6), the bottom view being a mirror image, and having the calibration etched or printed on said bottom surface of the ruler segments (1), when said Tool is composed essentially of a transparent material, and the bottom surface being uncalibrated if the Tool is composed essentially of an opaque material.
Figure 2:
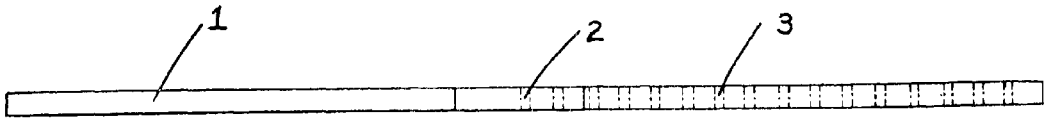
FIG. 2 shows a sectional side view of said simple embodiment of the Measuring Tool, the section lines being taken along lines 2—2 shown in FIG. 1.
Figure 3:
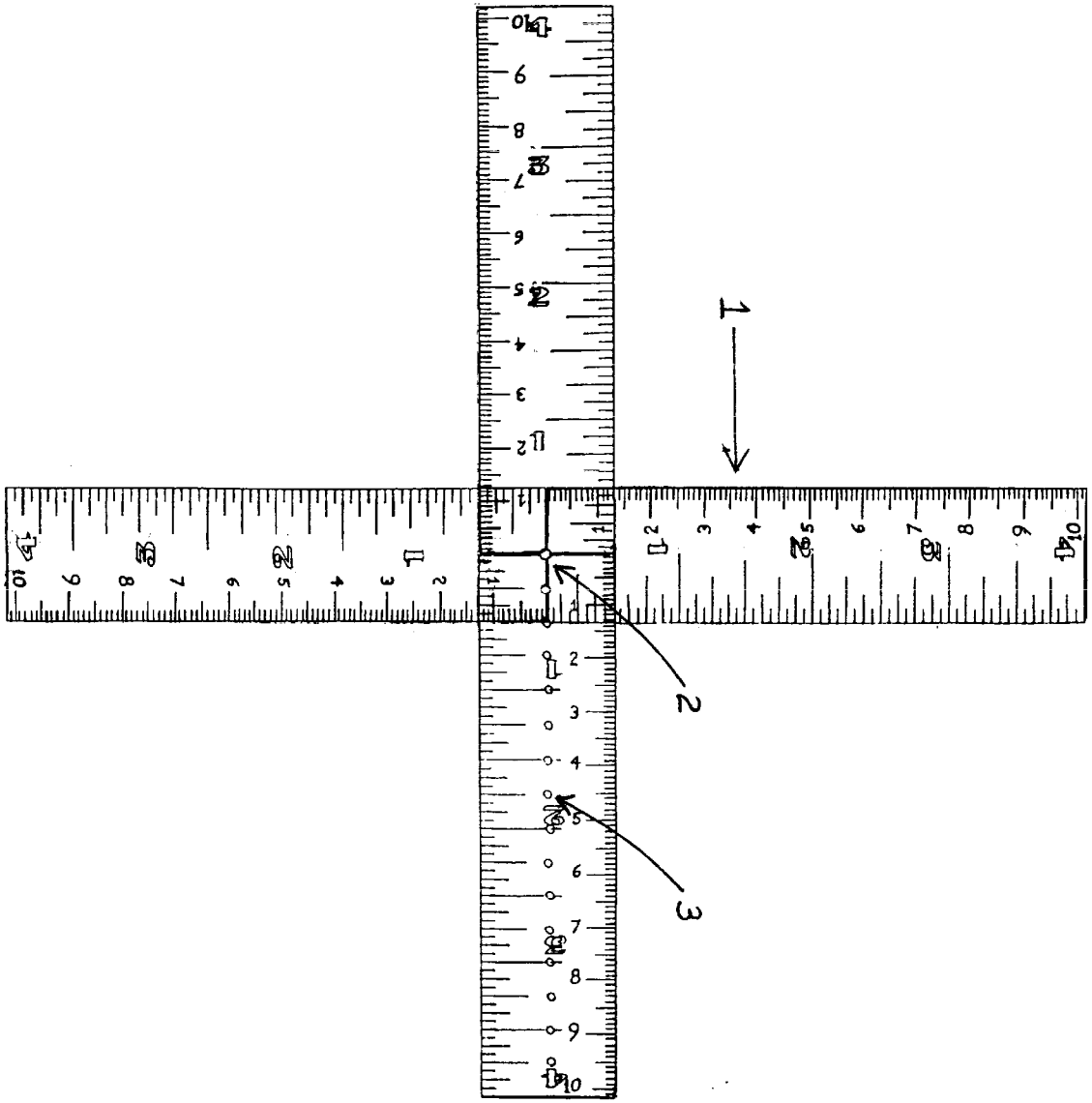
FIG. 3 shows a top view of a modified simple embodiment of the Measuring Tool, showing calibration in the English standard on the one longitudinal side of each ruler segment (1), and showing calibration in the metric system on the other longitudinal side of each ruler segment (1).
Figure 4:
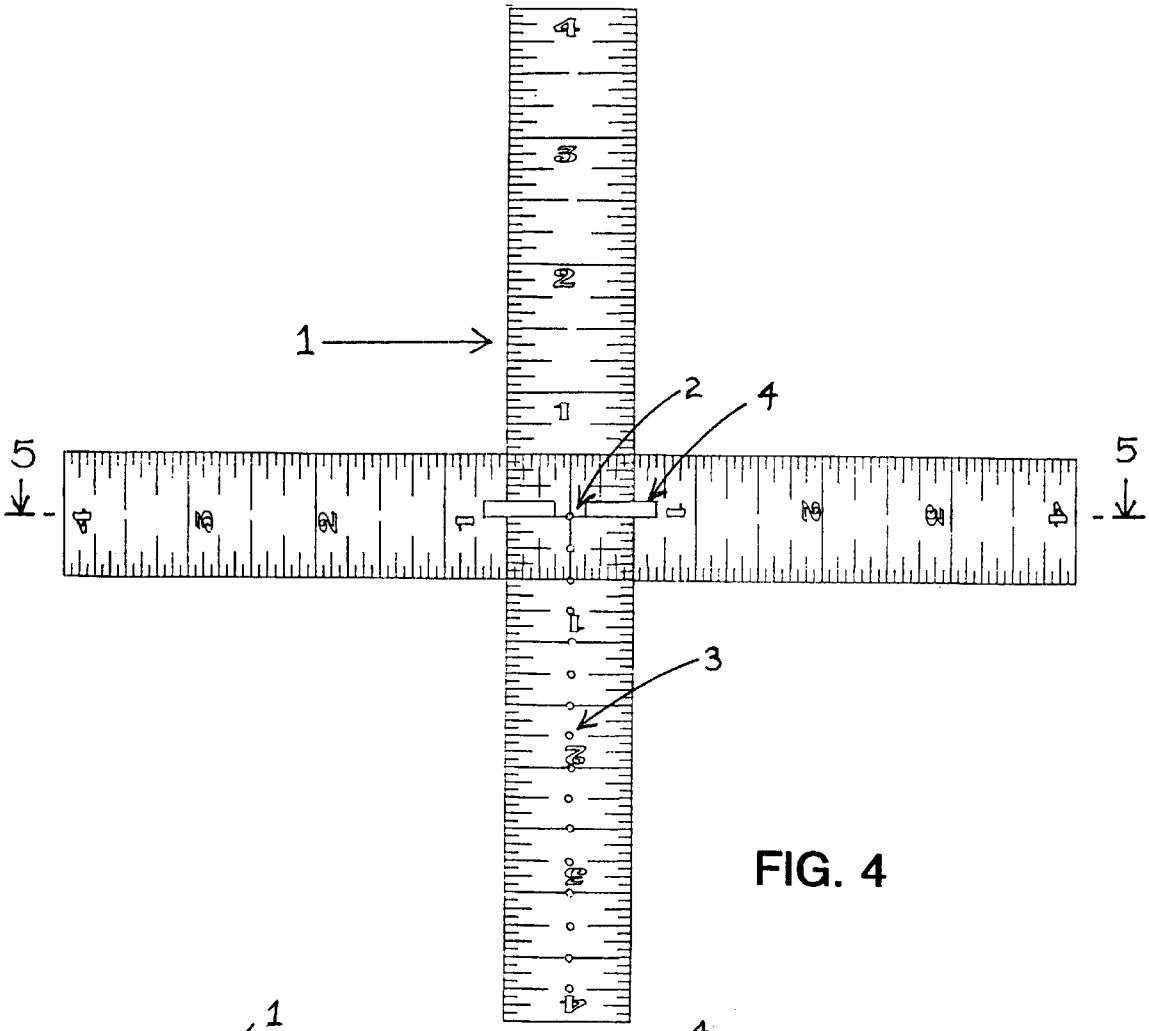
FIG. 4 shows a top view of a modified embodiment of the Measuring Tool with two small, centrally located alignment tabs (4) on the top surface of the Measuring Tool.
Figure 5:
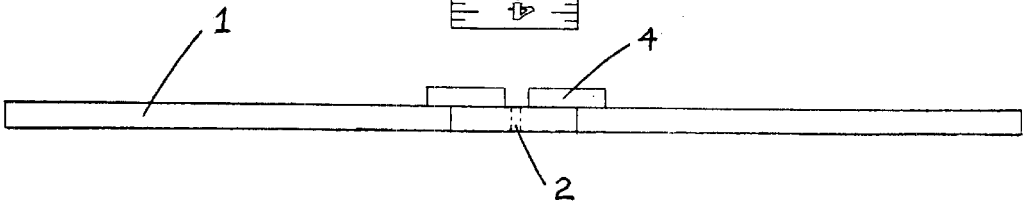
FIG. 5 shows a sectional side view of said Measuring Tool with two small, centrally located alignment tabs (4) on the top surface, the section lines being taken along lines 5—5 shown in FIG. 4.
Figure 6:
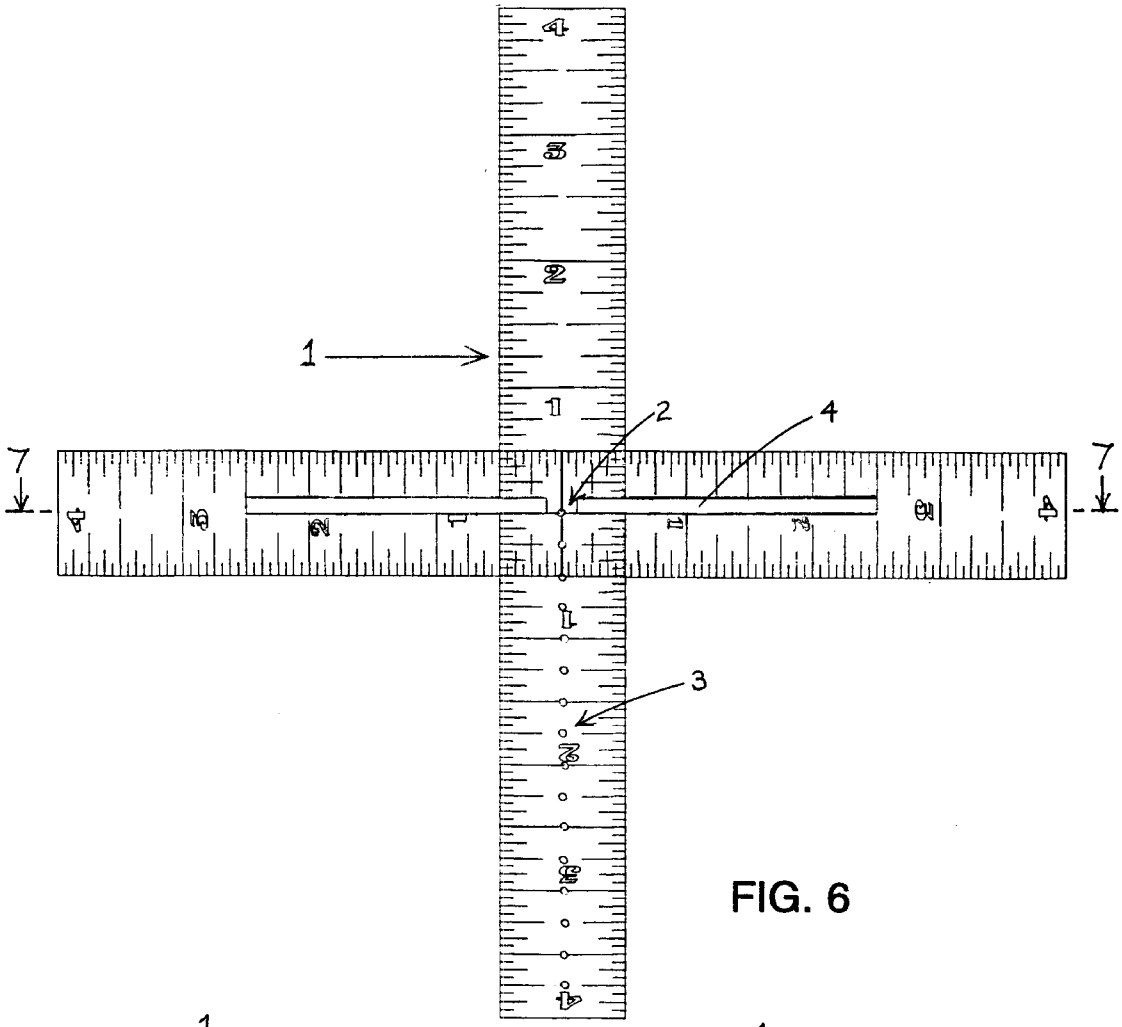
FIG. 6 shows a top view of a modified embodiment of the Measuring Tool with two elongated alignment tabs (4) on the top surface of the Measuring Tool.
Figure 7:
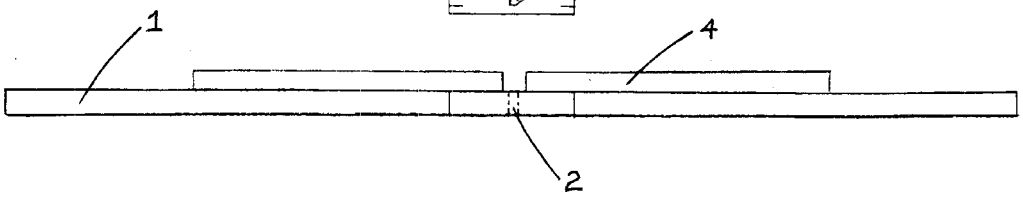
FIG. 7 shows a sectional side view of said modified simple embodiment of the Measuring Tool with two elongated alignment tabs (4) on the top surface, the section lines being taken along lines 7—7 shown in FIG. 6.

A simple embodiment of the Measuring Tool is comprised essentially of four ruler segments (1) joined together as a one-piece, cross-shaped tool, and such that each of said four ruler segments (1) are perpendicular to its two adjacent ruler segments (1). Each of the ruler segments (1) are calibrated with length dimensions, starting from the center hole (2) or common origin of said four ruler segments (1), as shown in FIG. 1. The calibration on the ruler segments (1) is preferred to be engraved or printed on the bottom side of the Measuring Tool so that said calibration may be read from the top side, if the Measuring Tool is composed essentially of a transparent or translucent material, such as a clear plastic, so that the reading or interpretation of said calibrations will be accurate. The calibration of the ruler segments (1) is located on the top surface of the Measuring Tool if the Measuring Tool is composed essentially of an opaque or nearly opaque material, such as wood or steel, so that the reading of the calibrations will be feasible. The calibration may be in the English standard, using, for example, inches, or may be in the decimal standard, using, for example, thousandths of an inch, or may be in the metric standard, using, for example, centimeters. The calibration standard may be located on the right side, the left side, or both sides of each ruler segment (1), as shown in FIG. 1. Alternately, the Measuring Tool may be calibrated with the desired calibration standard(s) on both the left side and the right side of each ruler segment (1), and as shown in FIG. 3. Some modified simple embodiments may, for example, use the English standard on one side of each ruler segment (1) and the metric standard or the decimal standard on the other side of each ruler segment (1), as shown in FIG. 3.

Figure 16:
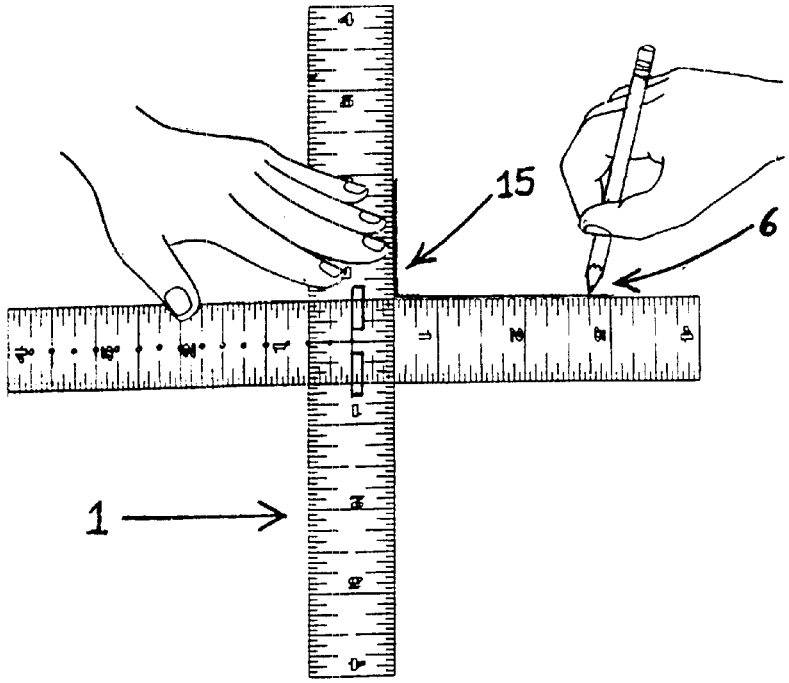
FIG. 16 shows a top view of an embodiment of the Measuring Tool immediately after being used with a pencil (6), to draw two line segments (15) from the origin of the two adjacent ruler segments (1).
Figure 17:
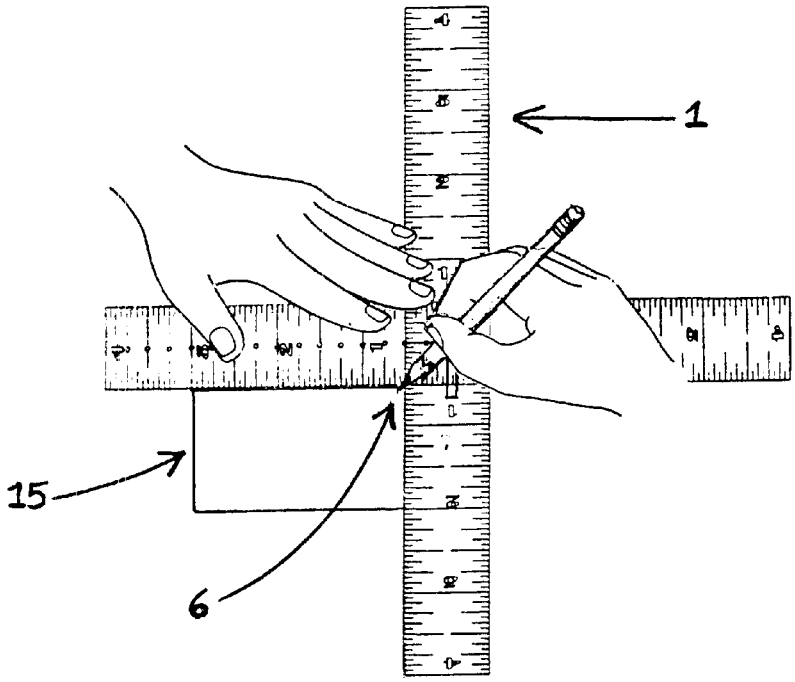
FIG. 17 shows a top view of said Measuring Tool moved in a diagonal manner, in the upper right direction, and after the end points of the previously drawn two line segments (15) are aligned with two adjacent ruler segments (1), and further showing the first of two new line segments (15) drawn along said ruler segment (1), to draw a rectangle.

A first major application of the ruler segments (1) is as a measuring tool to measure one or more lengths, concurrently, in one to four directions, at 90 degree angles, around the centrally located center guide hole (3). A second major application of the ruler segments (1) is as a center gauge for determining the center of a square, circular, or a regular polygon with an even number of sides work surface (7), by aligning the edge of the work surface (7) to equal distances on all four calibrated ruler segments (1). A third major application of the ruler segments (1) is as a center gauge for determining the center of a rectangle or an ellipse, by arranging the edge of the work surface (7) to equal distances on each of the two opposing sets of calibrated ruler segments (1). A fourth major application of the ruler segments (1) is that each of the four ruler segments (1) may be used as a straight edge for drawing line segments. A fifth major application of the ruler segments (1) is to sketch out a desired square or rectangle on a flat work surface (7), as shown in FIGS. 16 and 17. The desired square or rectangle may be sketched by placing the Measuring Tool on the flat work surface (7) and draw a line segment (15) along each of the two adjacent ruler segments (1) at a desired distance from the origin or intersection point of said two adjacent ruler segments (1). Two intersecting line segments (15) are now drawn, and which have two end points. The Measuring Tool is now placed in a position such that two adjacent ruler segments (1) contact said two end points. A pencil tip (6) or the like, may now be used to sketch out the completed square or rectangle by drawing two more line segments (15) from the origin or intersection of the two adjacent ruler segments (1), to the end points of the of the right angle previously drawn, such that this second set of line segments (15) are of corresponding equal length to the first set of line segments drawn (15), as shown in FIGS. 16 and 17.

Figure 18:
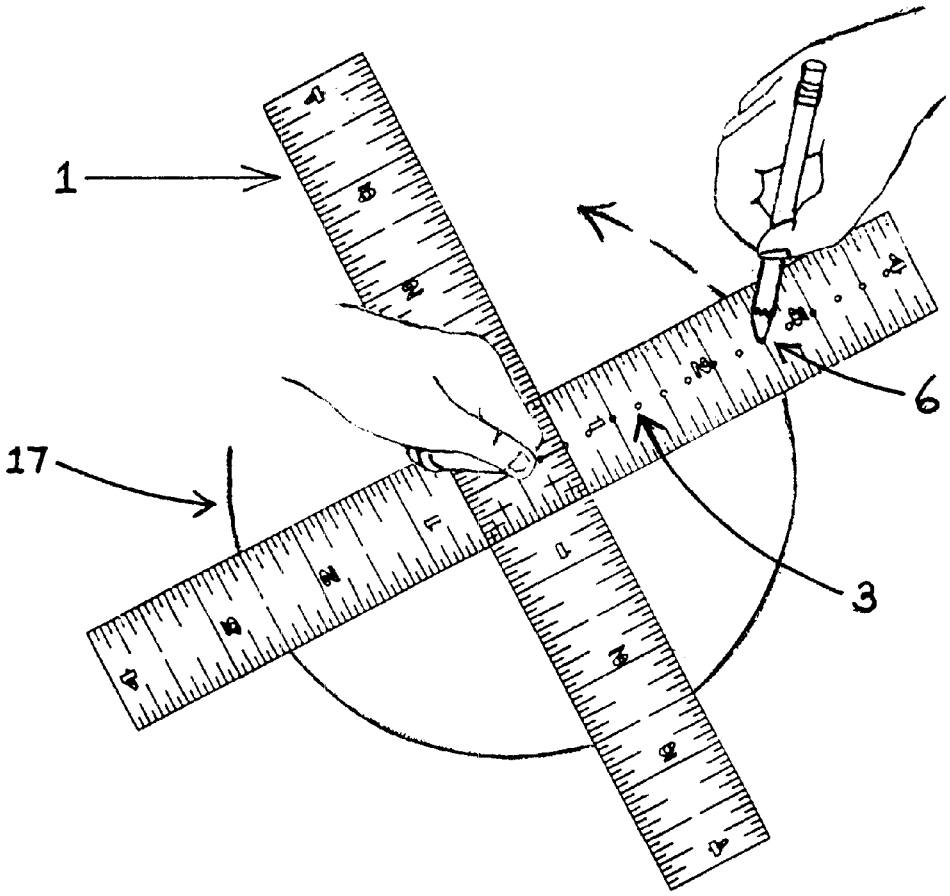
FIG. 18 shows a top view of an embodiment of the Measuring Tool with a pin (16) in the center hole (2) to stabilize the position of the central axis of the Measuring Tool, and with a pencil tip (6) drawing a circular arc (17), said arc (17) may continue to be drawn, to form a longer arc (17) or a circle.

The simple embodiments of the Measuring Tool also may have a plurality of guide holes (3), that may be used for receiving a pencil tip (6) or the like, and used to draw a circle, by affixing the center hole (2) to the work surface (7), with a pin (16), thumb tack, nail, or similar means, and at the desired location of a circle's point of origin or center point, and then placing a pencil tip (6) in the desired guide hole (3) for the desired circle radius, as shown in FIG. 18. Then utilizing the center hole (2) as the axis of rotation, the Measuring Tool may be rotated 360 degrees or more, to draw a circle on a desired object or surface, as shown in FIG. 18. The simple embodiments of the Measuring Tool also may have a plurality of guide holes (3), that may be used for receiving a pencil tip (6) or the like, and used to draw a circle arc or constant curvature line segment, by affixing the center hole (2) with a pin, thumb tack, nail, or similar means, and at the location of the circle origin of said circle arc or curved line segment, and then placing a pencil tip (6) in the desired guide hole (3) for the desired circle arc. Then utilizing the center hole (2) as the axis of rotation, the Measuring Tool may be rotated the desired length of the circle arc, so that said pencil (6) marks off the arc from one end point to the other end point, to draw the desired circle arc on the desired object or surface, also as shown in FIG. 18.

Some simple embodiments of the Measuring Tool, as well as some modified and preferred embodiments with ruler segments (1) using the English system of measurement have guide holes (3) centrally located along one of the ruler segments (1), and located at 0.25 inch intervals along the length of said ruler segment (1). Some simple embodiments of the Measuring Tool, as well as some modified and preferred embodiments, with ruler segments (1) using the metric system of measurement have guide holes (3) centrally located along one of the ruler segments (1), and located at 5 millimeter intervals along the length of said ruler segment (1).

An alternate and algorithmic description of the simple embodiments of the Measuring Tool would be a one-piece Measuring Tool, as shown e.g. in FIG. 1, comprised essentially of four ruler segments (1), such that each of the four ruler segments (1) extend along a common plane and each of the four ruler segments (1) extends from a common center hole (2) that perforates the Measuring Tool at the intersection of the four ruler segments (1), and also such that each of the four ruler segments (1) are perpendicular to their adjacent ruler segments (1) in this common plane. Some related embodiments may further have a plurality of guide holes (3) located on one of these four ruler segments (1). Some other embodiments may further have alignment tabs (4) located on the top surface of two non-adjacent ruler segments (1), such that neither of these two non-adjacent ruler segments (1) has guide holes (3) located thereon. A bubble level (10) may be added to any of the above-described embodiments, and may be located on each of two adjacent ruler segments (1). A protractor (11) may also be added to any of the above-described embodiments, and may be located in the common plane of the ruler segments (1), and between two non-adjacent ruler segments (1) that do not have guide holes (3) located thereon.

Another alternate description of the Measuring Tool would be four ruler segments (1) extending from a common centrally located center hole (2). Some embodiments of the Measuring Tool would further have a plurality of guide holes located on one of the four ruler segments (1). The one-piece embodiments of the Measuring Tool would have the ruler segments (1) perpendicular to their adjoining or neighboring ruler segments (1). Alignment tabs (4) may be added to the Measuring Tool and would optimally be located on the top surface of two non-adjacent ruler segments (1), such that neither of these non-adjacent ruler segments (1) has guide holes (3) located thereon. A protractor (11) may also be added to the Measuring Tool embodiments described herein, and would be located in a common plane between two non-adjacent ruler segments (1), such that neither of these non-adjacent ruler segments (1) have guide holes (3) located thereon. A specialized pivoting set of embodiments, further described below, would further have the above four ruler segments (1) comprised essentially of two sets of ruler segments, with each set of ruler segments (1) located in one of two parallel planes, comprising a top plane with two ruler segments (1) and a bottom plane with two ruler segments (1), and such that the top plane and the bottom plane are attached together with a centrally located pivot (13) surrounding the central hole (2), thereby allowing these two sets of ruler segments (1) in these two parallel planes, to rotate around a central axis for each of these two parallel planes, said central axis being the pivot (13) surrounding the central hole (2). Another specialized pivoting embodiment would be further comprised of a protractor slot (18) located on the protractor (11) that is extending from the edge of a ruler segment (1) in the top plane, and extending to a protractor tightening screw (19) attached to the bottom plane of the Measuring Tool, such that the protractor tightening screw (19) is passing upwards and through the protractor slot (19), thereby attaching the protractor (11) with the protractor slot (19) to the bottom plane of the Measuring Tool.

DESCRIPTION OF A PREFERRED EMBODIMENT OF THE MEASURING TOOL

Figure 19:
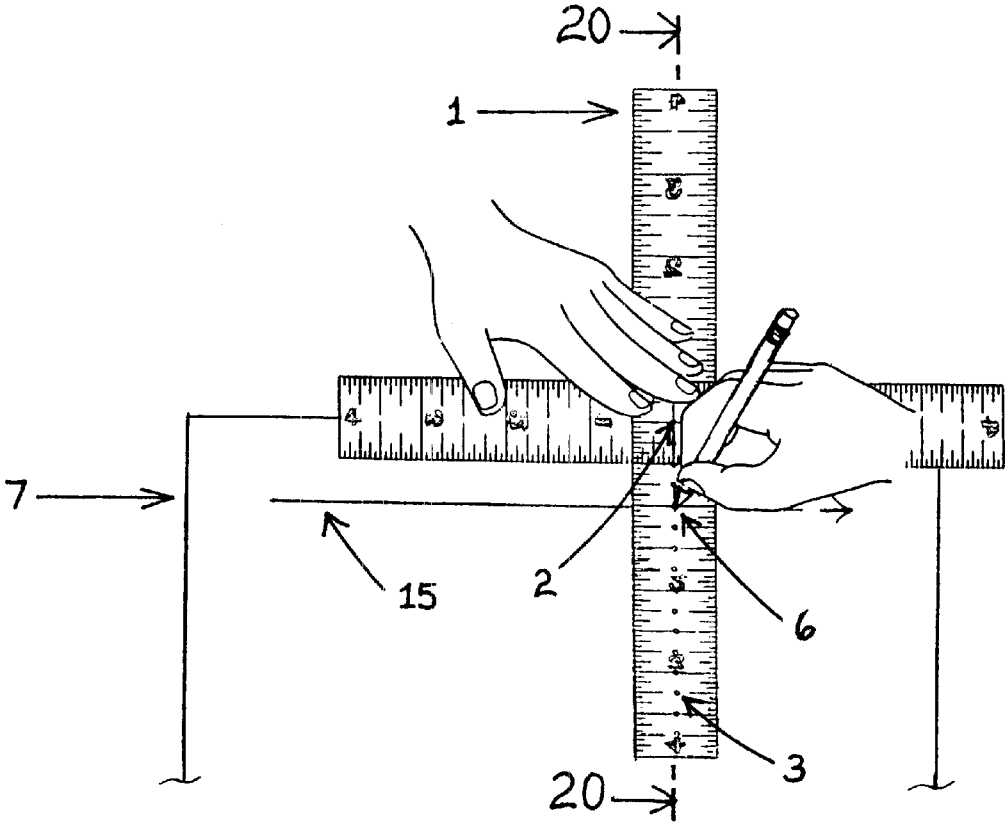
FIG. 19 shows a bottom view of an embodiment of the Measuring Tool being used to draw a line segment (15) parallel to the edge of the work surface (7) by setting the alignment tabs (4) now extending downward from the Measuring Tool and flush against the selected edge of the work surface (7), and then by placing a pencil tip (6) into the selected guide hole (3) and moving the Measuring Tool in the desire direction, to sketch-out the desired parallel line segment (15).
Figure 20:
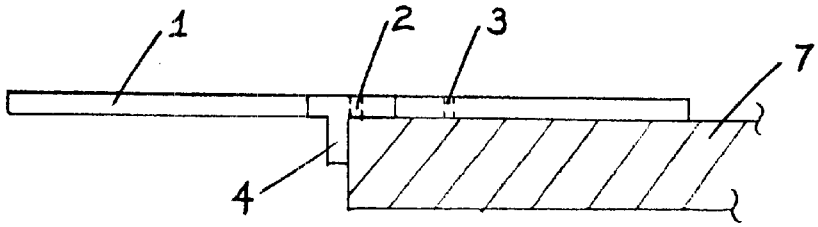
FIG. 20 shows a sectional side view of said Measuring Tool with an alignment tab (4) flush against a work surface (7), and with a guide hole (3) shown, the section lines taken along lines 20—20 shown in FIG. 19.
Figure 21:
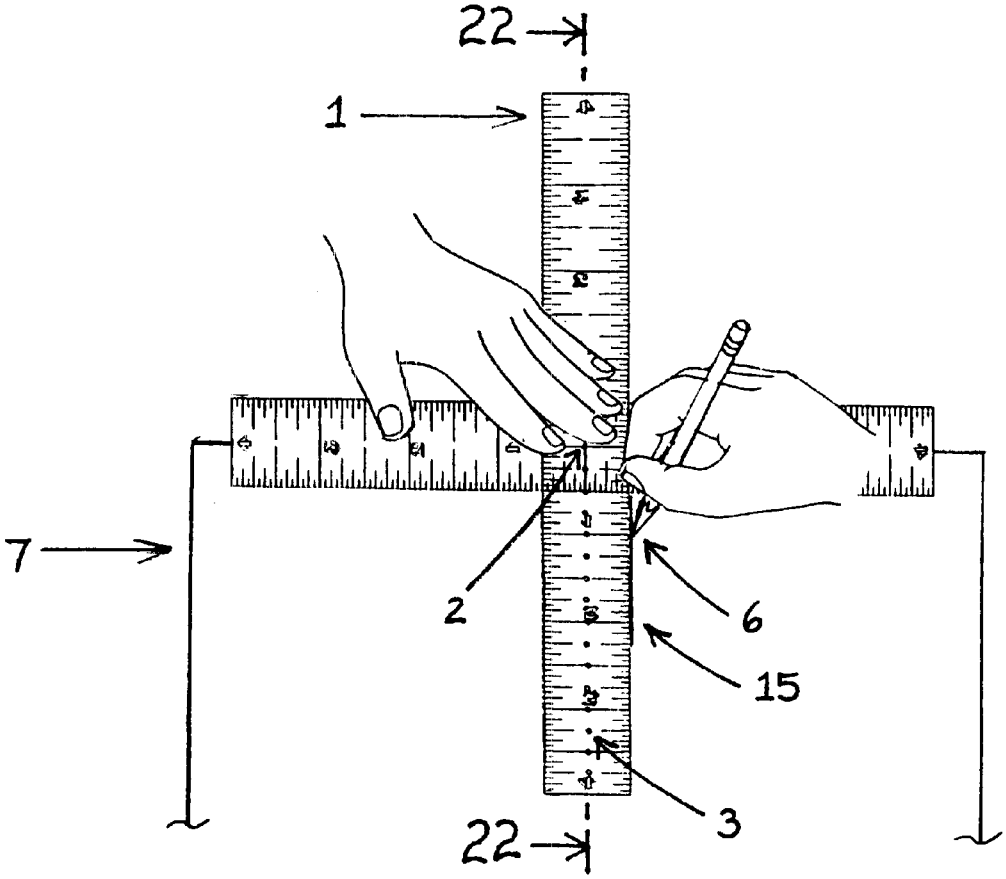
FIG. 21 shows a bottom view of the Measuring Tool being used to draw a line segment (15) perpendicular to the edge of the work surface (7) by setting the alignment tabs (4) now extending downward from the Measuring Tool and flush against the selected edge of the work surface (7), and then by placing a pencil tip (6) along the desired edge of the ruler segment (1) that is perpendicular to said edge of the work surface (7), and then moving the pencil the desired length along said edge of the ruler segment (1) to draw the desired perpendicular line on the work surface (7).
Figure 22:
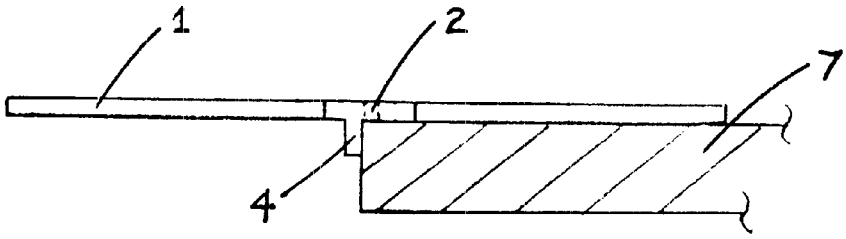
FIG. 22 shows a sectional side view of said Measuring Tool with an alignment tab (4) flush against the selected edge of the work surface (7), the section lines taken along lines 22—22 shown in FIG. 21.
Figure 23:
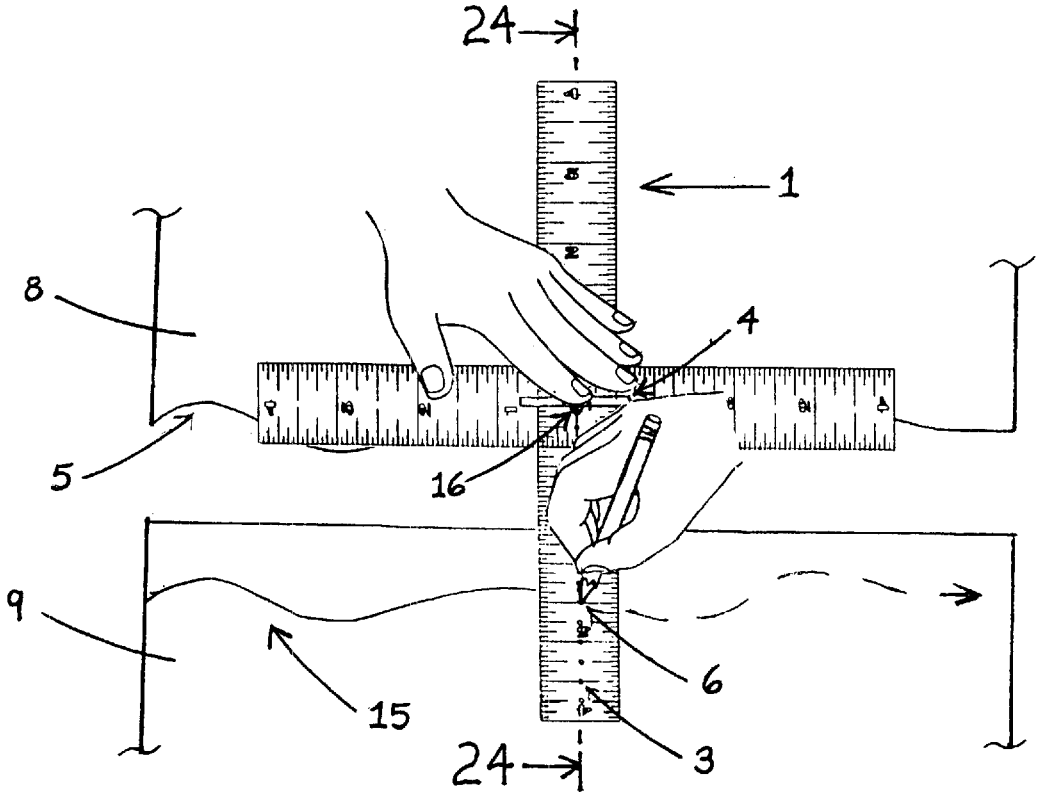
FIG. 23 shows a top view of the Measuring Tool with a pin (16) inserted through the center hole (2), and said pin (16) being flush against the selected edge line (5) of the first flat surface (8), and showing a pencil tip (6) inserted into a selected guide hole (3) such that said tip will transcribe or transfer the desired portion of the shape of the edge line (5) of the first flat surface (8) by drawing said shape onto an adjacent second flat work surface (9).
Figure 24:
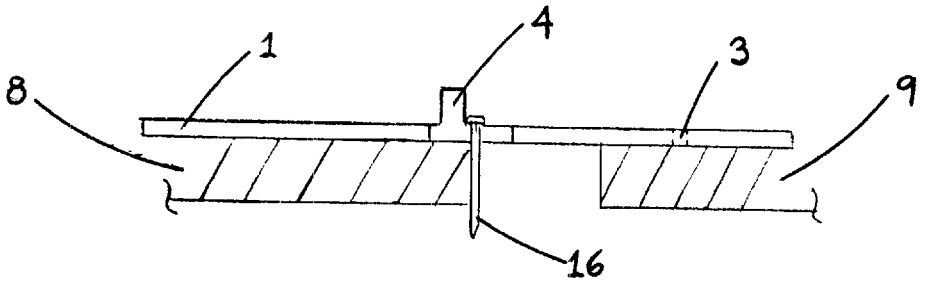
FIG. 24 shows a sectional side view of said Measuring Tool with a pin (16) inserted into the center hole (2) such that said pin (16) is flush against the edge line (5) of the first flat work surface (8), and the ruler segment with the guide holes (3) protrudes onto the top surface of the second flat work surface (9), thereby allowing the user to draw a line segment (15) on the second flat work surface (9), that is a transcription of the edge line (5) of the first flat work surface (8).
Figure 25:
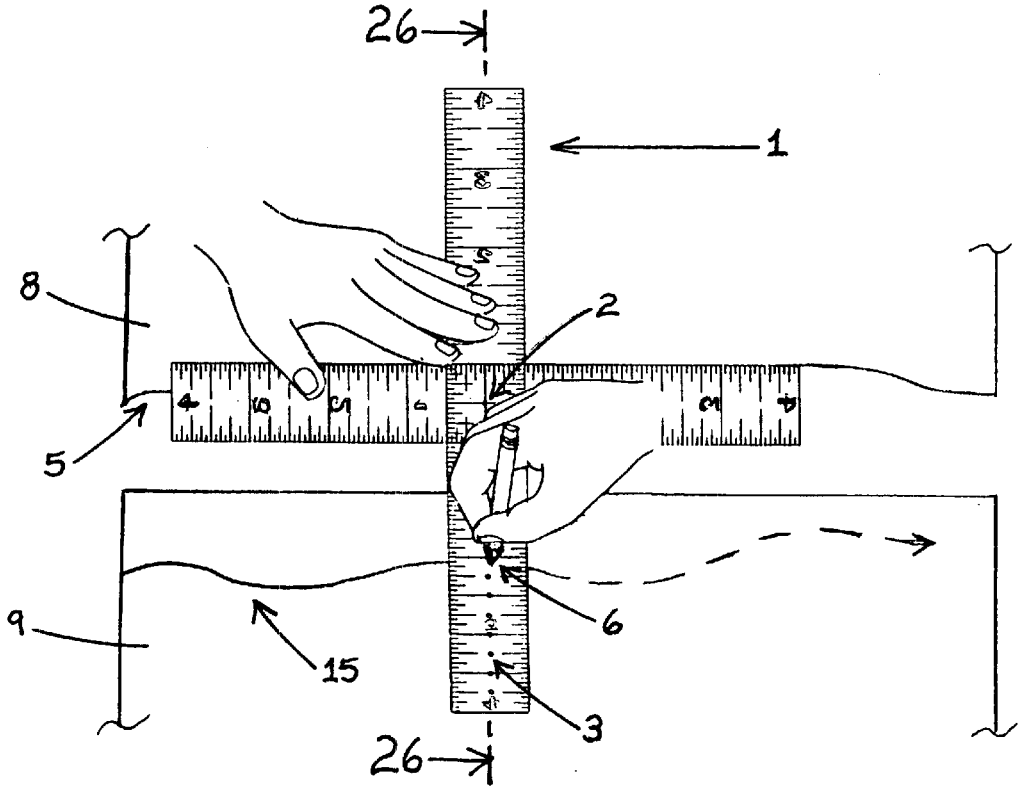
FIG. 25 shows a view of the Measuring Tool shown in FIGS. 4 and 5 now in the inverted position, with the alignment tabs (4) now extending downward from the Measuring Tool, and said alignment tabs (4) set flush against the edge line (5) of the first flat surface (8), and showing a pencil tip (6) inserted into a selected guide hole (3) such that said pencil tip (6) will transcribe or transfer the desired portion of the shape of the edge line (5) of the first flat surface (8) by drawing said shape onto an adjacent second flat work surface (9), when the user moves the Measuring Tool in the desired direction, using the alignment tabs (4) as a guide that is set flush against the edge line (5) of the first flat surface (8).
Figure 26:
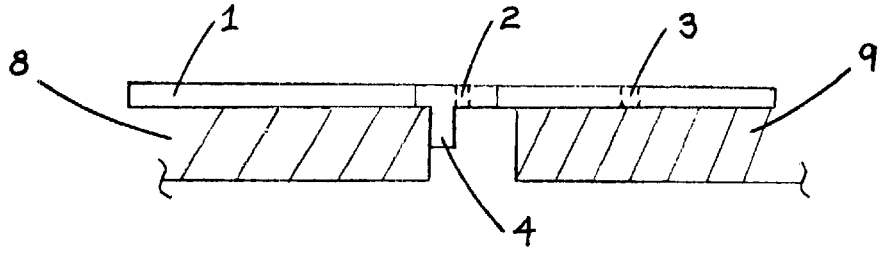
FIG. 26 shows a sectional side view of said Measuring Tool in the inverted position, an with an alignment tab (4) now extending downward from the Measuring Tool and flush against the edge line (5) of the first flat work surface (8), and the ruler segment (1) with the guide holes (3) protrudes onto the top surface of the second flat work surface (9), thereby allowing the user to draw a line segment (15) on the second flat work surface (9) that is a transcription of the edge line (5) of the first flat work surface (8), by moving the Measuring Tool in the desired direction, using the alignment tab (4) as a guide that is set flush against the edge line (5) of the first flat surface (8).

A preferred embodiment of the Measuring Tool would be essentially comprised of the elements of the simple embodiment and would be further comprised of a set of one or more alignment tabs (4), that are located on the top surface of the Measuring Tool, as shown in FIGS. 4 through 7. These alignment tabs (4) would run perpendicular to the ruler segment (1) with the guide holes (3) located thereon. The alignment tabs (4) would also be aligned with the center hole (2) of the Measuring Tool such that said tabs (4) effectively bisects the center hole (2), and would optimally be located in a straight line extending along two of the four ruler segments (1). The alignment of these alignment tabs (4) is such that they would allow the user to measure from the edge of the work surface (7) or material. A first major application of these alignment tabs (4) is to allow the user to draw a straight line segment (15) on the flat work surface (7) of the desired material, such that the straight line segment (15) would be parallel with the edge of the flat work surface (7) or material, as shown in FIGS. 19 and 20. This is achieved by placing the Measuring Tool in the inverted position, with the alignment tabs (4) now extending downward from the Measuring Tool, and setting the alignment tabs (4) flush with the selected edge of the flat work surface (7) or object where a straight line segment (15) is to be drawn. The position of the straight line, parallel to said edge of the flat work surface (7) or material, is then determined. Then a pencil tip (6) is placed in the desired guide hole (3), and the Measuring Tool is moved along the desired length of the edge of the flat work surface (7) or material, thereby drawing-out a straight line, parallel to said edge, as shown in FIGS. 19 and 20. The second major application of these alignment tabs (4) is that of a T-square, to allow the user to draw a perpendicular line segment (15) on the surface of the desired flat work surface (7) or material, such that the perpendicular line segment (15) would be perpendicular with the edge of the flat work surface (7) or material. This is achieved by placing the Measuring Tool in the inverted position, with the alignment tabs (4) extending downward from the Measuring Tool, and setting the alignment tabs (4) flush with the edge of the flat work surface (7) or object where a perpendicular line segment (15) is to be drawn, as shown in FIGS. 21 and 22. The position of the straight line segment (15), perpendicular to said edge of the flat work surface (7) or material, is then determined. Then a pencil tip (6) is placed along the desired ruler segment (1) of the edge perpendicular to the alignment tabs (4), and the alignment tabs (4) are placed against the edge of the flat work surface (7) or material, the pencil may now be used to draw a perpendicular line segment (15) of desired length from the edge of the flat work surface (7) or material, by drawing-out a line segment (15) along said ruler segment (1), as shown in FIG. 21. A third major application of these alignment tabs (4) is to allow the user to draw a curved or wavy line segment (15) on the flat work surface (7) of the desired material, such that the curved or wavy line segment (15) would be parallel with the curved edge of the material or surface. This is achieved by placing the Measuring Tool in the inverted position, with the alignment tabs (4) extending downward from the Measuring Tool, and setting the alignment tabs (4) flush with the selected edge of the flat work surface (7) or object where a curved or wavy line segment (15) is to be drawn. The position of the curved or wavy line segment (15), parallel to said curved edge of the flat work surface (7), material or object, is then determined by choosing the guide hole (3) at the desired distance from the curved edge of the flat work surface (7), material or object. Then a pencil tip (6) is placed in the desired guide hole (3), and the Measuring Tool is moved along the desired length of the edge of the material or work surface (7), thereby drawing-out a curved or wavy line segment (15) that traces out a curved line segment (15) that is also parallel to said curved edge. This third application of the alignment tabs (4) in duplicating a curved or wavy line segment (15) is achieved in a manner similar to that illustrated in FIGS. 19 and 20, for duplicating a parallel line segment (15). The fourth major application of these alignment tabs (4) is to allow the user to duplicate or copy a selected segment of an edge from a first flat top surface (8) to a second flat top surface (9). This may be achieved using two methods. The first method of duplicating the edge of a first flat top surface (8), is to insert a pin (16) or the like through the center guide hole (3) of the Measuring Tool, such that said pin (16) would extend below the Measuring Tool and be aligned with the edge of the first. flat top surface (8), i.e., the parent top surface. Then the desired guide hole (3) is selected for the desired location of the transcribed or transferred edge line (5) on the second flat top surface (9), i.e., the daughter top surface, that is adjacent to the first flat work surface (8), as shown in FIGS. 23 and 24. Said edge line (5) is transcribed or transferred by placing a pencil tip (6) in said desired guide hole (3), and the Measuring Tool is moved along the desired length of the edge of the first flat surface (8), i.e., the original or parent work surface, thereby transferring or transcribing the edge line (5) from the first flat surface (8) to the second flat surface (9), i.e., the daughter work surface, as shown in FIGS. 23 and 24. The second method of duplicating the edge of a flat top work surface (7), is to place the Measuring Tool in the inverted position, with the alignment tabs (4) extending downward from the Measuring Tool and setting the alignment tabs (4) flush with the selected edge of the first flat surface (8), i.e., the parent work surface, as shown in FIGS. 25 and 26. Then the desired guide hole (3) is selected for the desired location of the transcribed or transferred edge line on the second flat surface (9), i.e., daughter work surface. Said edge line (5) is transcribed or transferred by placing a pencil tip (6) in said desired guide hole (3) and the Measuring Tool is moved along the desired length of the edge of the first flat surface (8), thereby transcribing or transferring the edge line (5) from the first flat surface (8), to the second flat work surface (9).

A preferred embodiment of the Measuring Tool using the English system of measurement has guide holes (3) centrally located along one of the ruler segments (1), and located at 0.25 inch intervals along the length of said ruler segment (1). A preferred embodiment of the Measuring Tool using the metric system of measurement has guide holes (3) centrally located along one of the ruler segments (1), and located at 5 millimeter intervals along the length of said ruler segment (1).

DESCRIPTION OF A PIVOTING EMBODIMENT OF THE MEASURING TOOL

Figure 12:
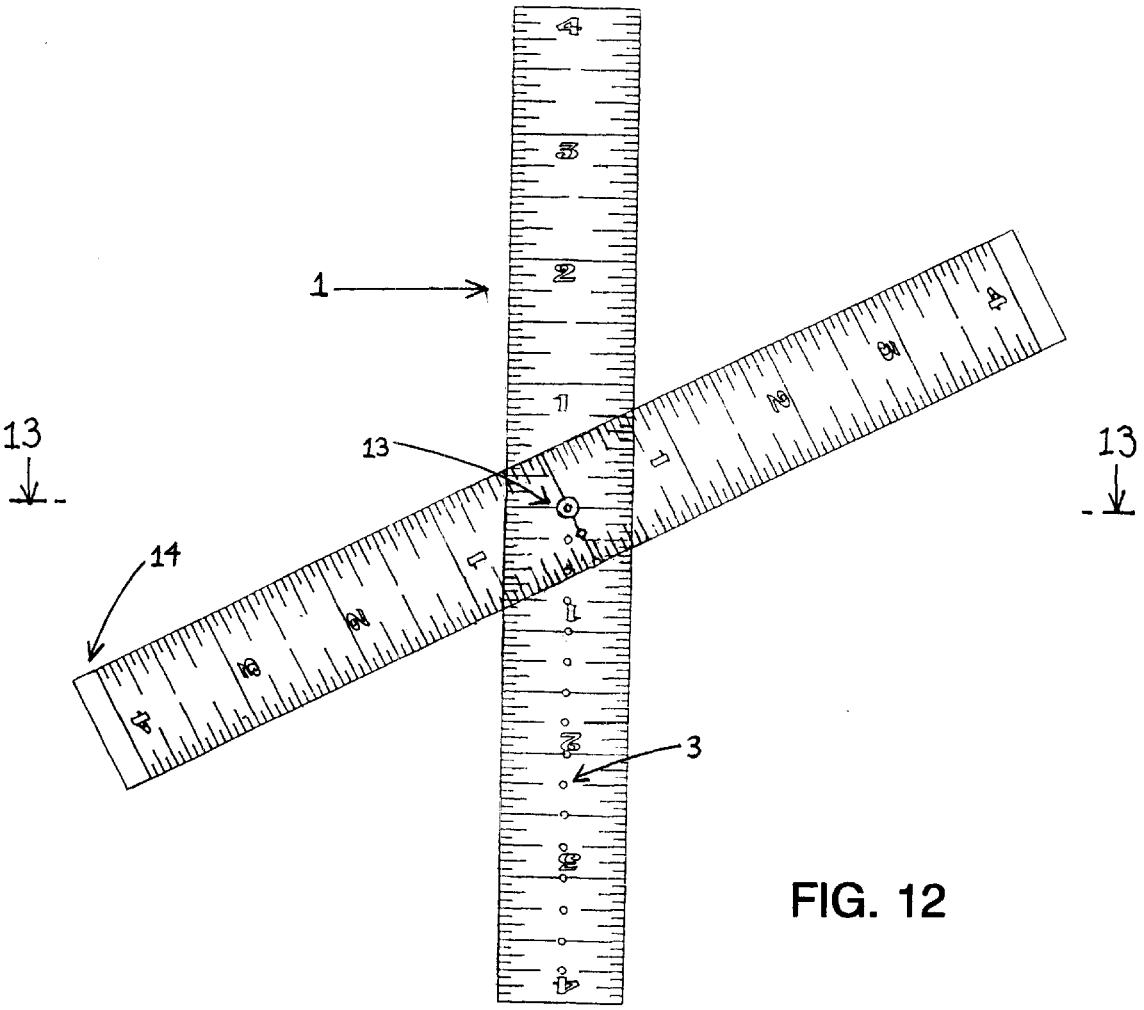
FIG. 12 shows a top view of an embodiment of the Measuring Tool with a centrally located pivot (13), grommet, or the like, whereby two opposite and non-adjacent ruler segments (1) may be moved about a centrally located pivot (13) or axis, and with a set of stability feet (14) located near the terminal end of the two opposite and non-adjacent ruler segments (1) that are at a higher elevation, when the Measuring Tool is laid flat on a work surface (7).
Figure 13:
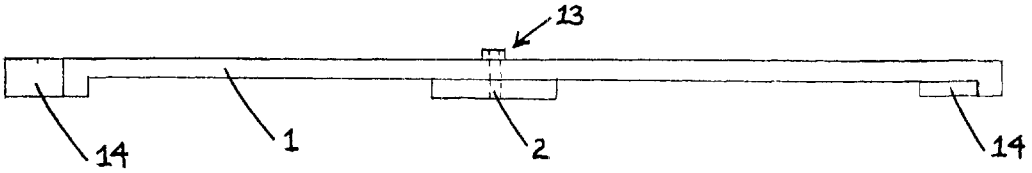
FIG. 13 shows a sectional side view of said Measuring Tool with a pivot (13), the section lines taken along lines 13—13 shown in FIG. 12.
Figure 14:
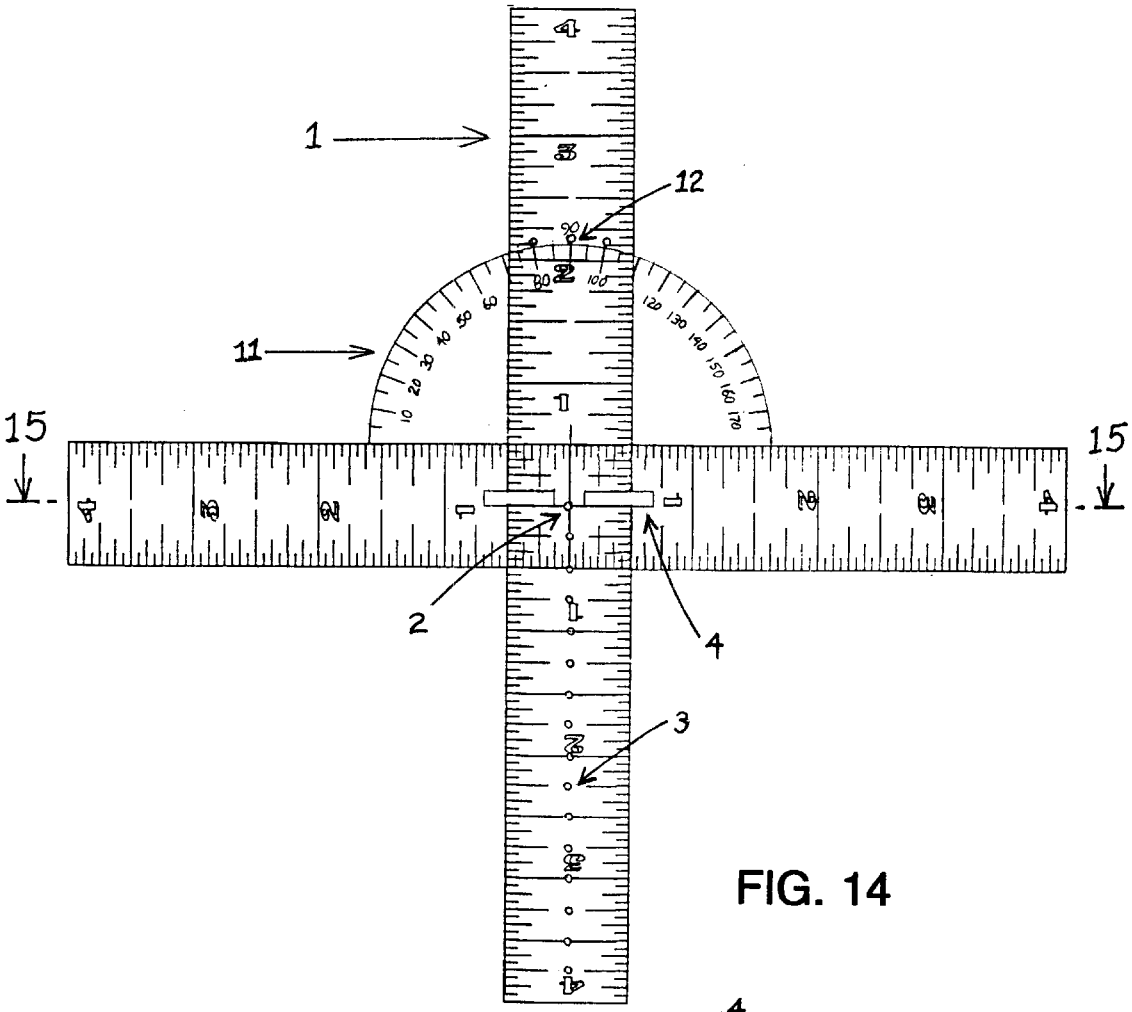
FIG. 14 shows a top view of an embodiment of the Measuring Tool with two alignment tabs (4) and a protractor (11) on the ruler segment (1) opposite to the ruler segment (1) with guide holes (3), as shown, and with three protractor marking holes (12) at 10-degree intervals on the portion of the ruler segment (1) overlapping the protractor (11).
Figure 15:
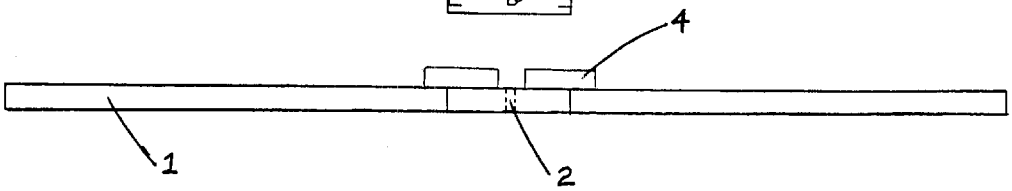
FIG. 15 shows a sectional side view of said Measuring Tool with two alignment tabs (4) and a protractor (11), the section lines taken along lines 15—15 shown in FIG. 14.

A simple pivoting embodiment of the Measuring Tool would be comprised essentially of the elements of the simple embodiment and would be further comprised essentially of a pivoting means that may be centrally located around the center hole (2). Said pivoting means may be a pivot (13) or similar means, such as a grommet. This modified embodiment also may be further comprised of stability feet (14) located at the terminal ends of the top ruler segment (1), as shown in FIGS. 12 and 13. The advantage of utilizing the stability feet (14) in this embodiment are that it steadies or keeps the Measuring Tool level to the work surface (7), during use. Another advantage of the pivot (13) used in this embodiment include an angle copying application, where the two opposing ruler segments (1) may be pivoted and thereby set to the same angle as an angle on a work surface (7), thereby allowing the user to copy said angle to another work surface (7), because the set angle and its opposite interior angle in this pivoting embodiment of the Measuring Tool, will be equal angles, and may be utilized to re-draw an equal angle on another work surface (7). A further advantage of the pivoting embodiments of the Measuring Tool are that the top ruler segments (1) may also be used as alignment tabs (4). Another significant advantage of the pivoting embodiments of the Measuring Tool are that the perpendicular ruler segments (1) may be pivoted about the central axis to overlap and become an easier-to-store and carry compactified linear Measuring Tool, rather than a fixed cross-shaped Measuring Tool, that may be more difficult to store and carry.

An alternate and algorithmic description of the pivoting embodiments would be a Measuring Tool comprised essentially of four ruler segments (1), such that two of the ruler segments (1) are adjoined in a top plane and comprise a top element of the Measuring Tool, and such that the remaining two ruler segments (1) are adjoined in a bottom plane and comprise a bottom element of the Measuring Tool, such that the top element with its two ruler segments (1) is parallel to the bottom element with its two ruler segments (1), and the top element is attached to the bottom element with a pivot (13) means or the like. Some related embodiments may further include a stability foot (14) located on the underside of each of the two terminal ends of the top element of the Measuring Tool. Some additional embodiments may also include the above described Measuring Tools, with a protractor (11) with a protractor slot (18), such that the protractor (11) extends from an edge of a ruler segment located on the top element of the Measuring Tool, and in the same plane as the ruler segment (1) located on the top element, and such that a protractor tightening screw (19) is attached to a ruler segment (1) located on the bottom element of the Measuring Tool, and extending through the protractor slot (18), thereby also attaching the protractor (11) to the ruler segment (1) located on the bottom element.

DESCRIPTION OF AN EMBODIMENT OF THE MEASURING TOOL WITH PROTRACTOR

Figure 10:
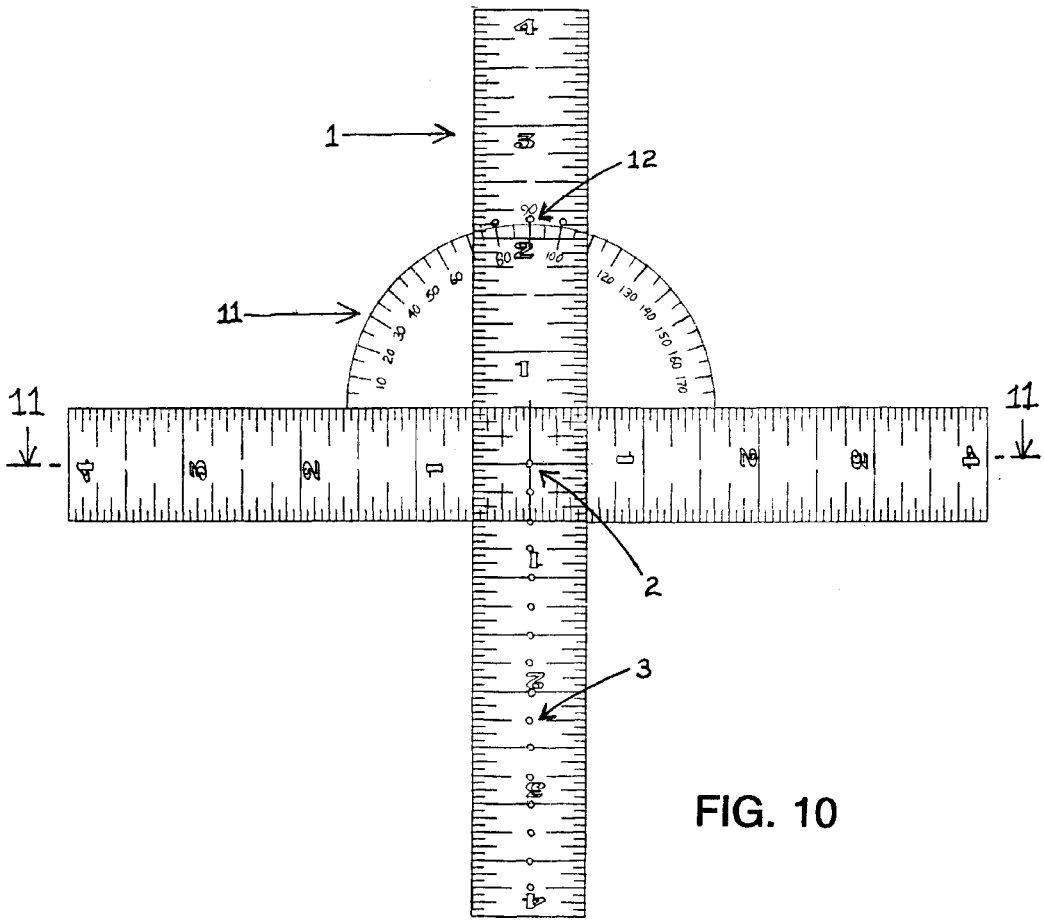
FIG. 10 shows a top view of an embodiment of the Measuring Tool with a protractor (11) on the ruler segment (1) opposite to the ruler segment (1) with guide holes (3), as shown, and with three protractor marking holes (12) at 10-degree intervals on the portion of the ruler segment (1) overlapping the protractor (11).
Figure 11:
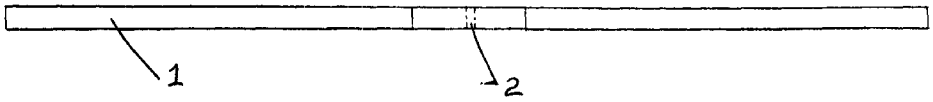
FIG. 11 shows a sectional side view of said embodiment of the Measuring Tool with a protractor (11), the section lines taken along lines 11—11 shown in FIG. 10.

A modified embodiment of the Measuring Tool with Protractor would be comprised essentially of the elements of the simple embodiment and would be further comprised essentially of a protractor (11) attached and located on the two ruler segments perpendicular to the ruler segment (1) with guide holes (3) thereon, as shown in FIGS. 10 and 11. Some modifications of this embodiments may have additional guide holes (3) located on the portion of the protractor (11) that overlaps the ruler segment (1), as shown in FIG. 10, and there using guide holes (3) at 10 degree increments.

Figure 27:
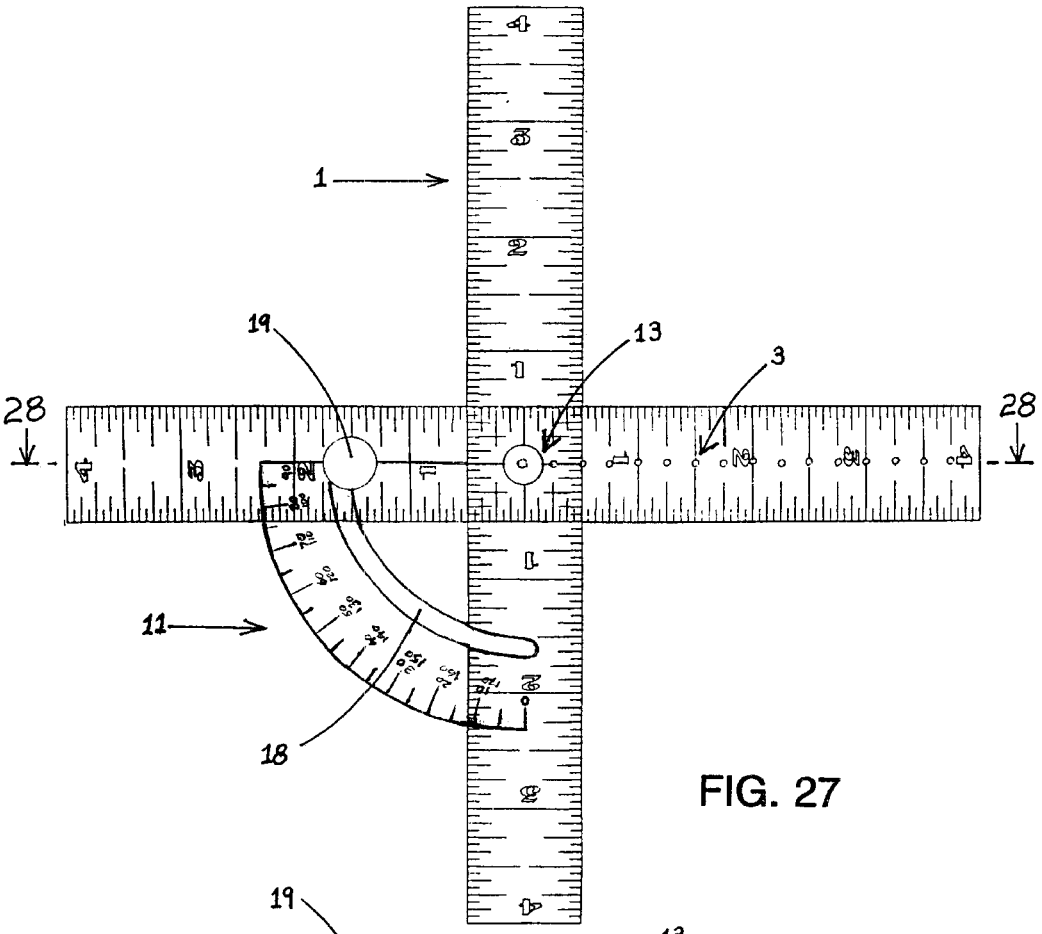
FIG. 27 shows a top view of the Measuring Tool with a centrally located pivot (13), grommet, axis, or the like, whereby two opposite and nonadjacent ruler segments (1) may be moved about said pivot (13), and with a clear plastic protractor (11) located on the top set of clear plastic ruler segments (1).
Figure 28:
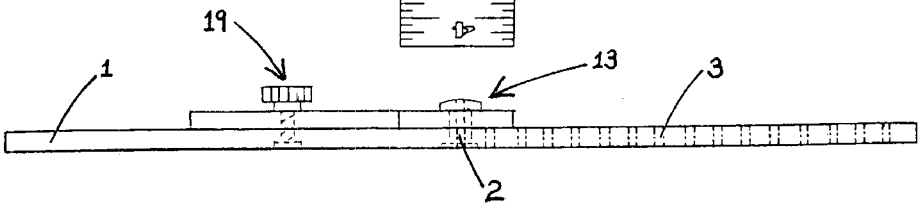
FIG. 28 shows a sectional side view of said Measuring Tool with a centrally located pivot (13), the section lines taken along lines 28—28 shown in FIG. 27.
Figure 29:
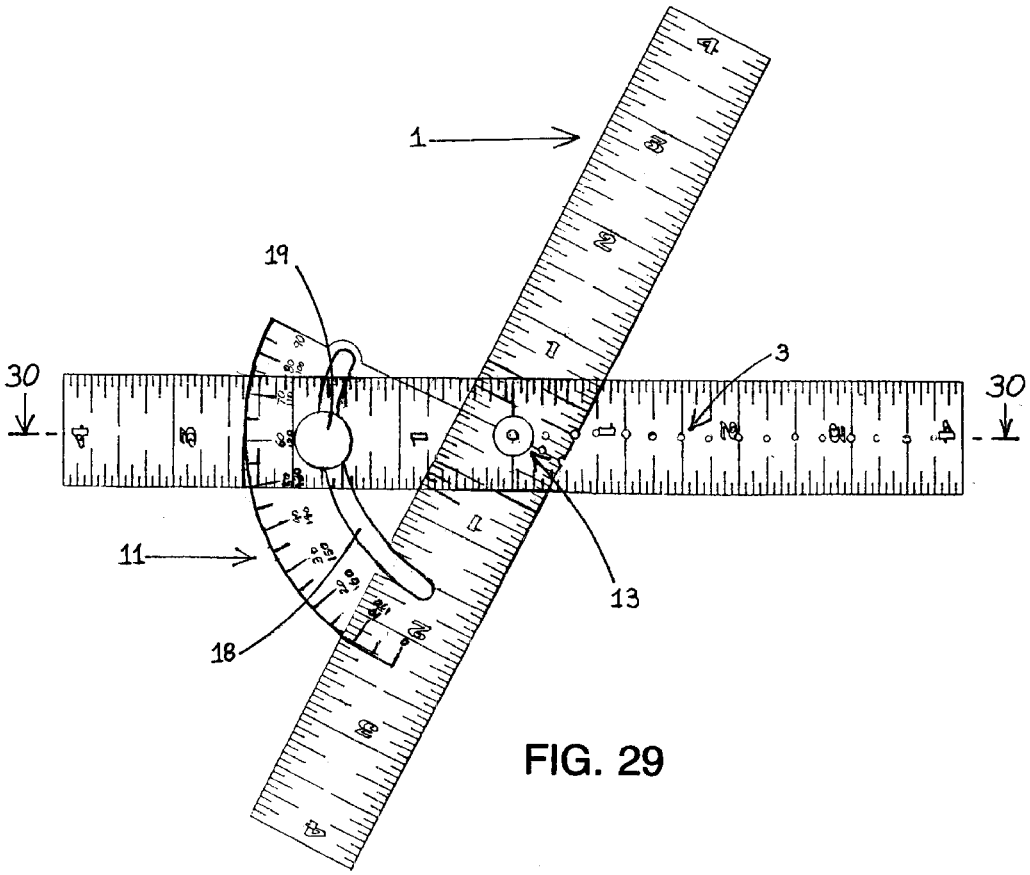
FIG. 29 shows a top view of the Measuring Tool as shown in FIG. 27, and is shown pivoted to an angle other than 90-degrees, and showing the two guide holes (3) located on said clear top ruler segment (1) are now not aligned with the guide holes (3) of the lower ruler segment (1).
Figure 30:
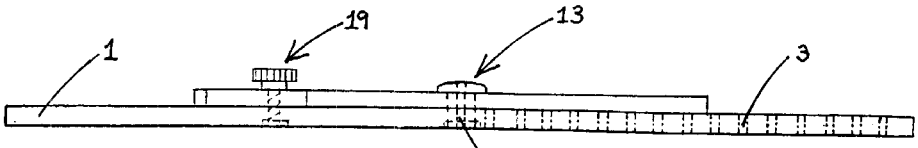
FIG. 30 shows a sectional side view of said Measuring Tool with a centrally located pivot (13), the section lines 30—30 shown in FIG. 29.

Another modified embodiment of the Measuring Tool with Protractor would be a Pivoting Measuring Tool with Protractor, comprised essentially of the elements of the simple pivoting embodiment of the Measuring Tool, and would further be comprised essentially of a protractor (11) with a protractor slot (18), attached and protruding from one ruler segment (1), and affixed to an adjacent ruler segment (1) with a protractor tightening screw (19) located on said adjacent ruler segment (1), and extending through the protractor slot (18), which extends over the adjacent rule segment (1), as shown in FIGS. 27 through 30. The protractor tightening screw (19) may be loosened or tightened to adjust and affix the pivoting ruler segments (1) and protractor (11), according to the needs of the user, and as shown in FIGS. 27 and 29.

Figure 31:
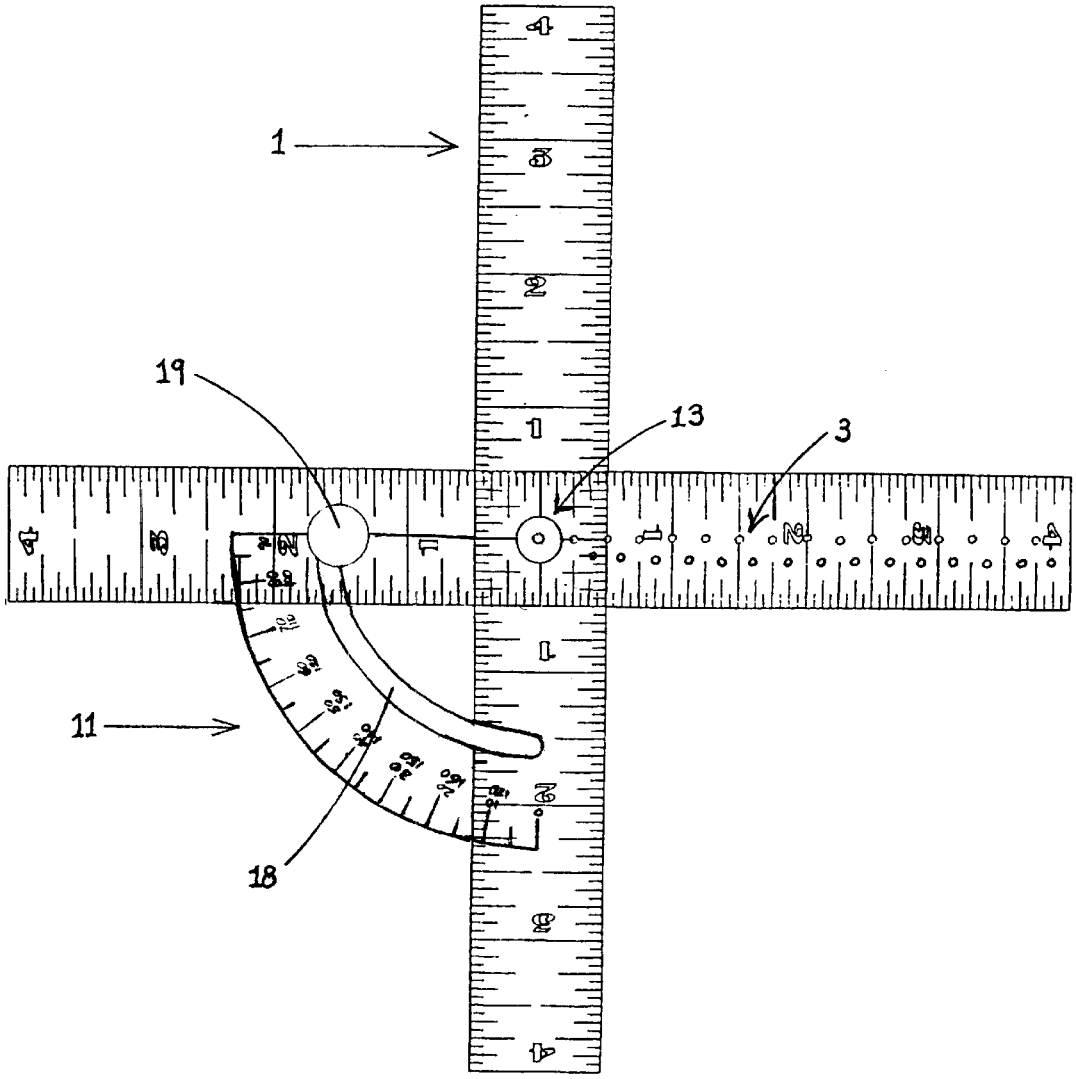
FIG. 31 shows a top view of the Measuring Tool with a centrally located pivot (13), grommet, axis, or the like, whereby two opposite and nonadjacent ruler segments (1) may be moved about said pivot (13), and with a clear plastic protractor (11) located on the top set of clear plastic ruler segments (1), the bottom set of ruler segments (1) being thinner than the top set of ruler segments (1), and a bottom ruler segment (1) having two sets of parallel and offset guide holes (3), the guide holes (3) of each set being 0.25 inch apart, and such that the guide holes (3) from each opposing set being 0.125 inch apart.
Figure 32:
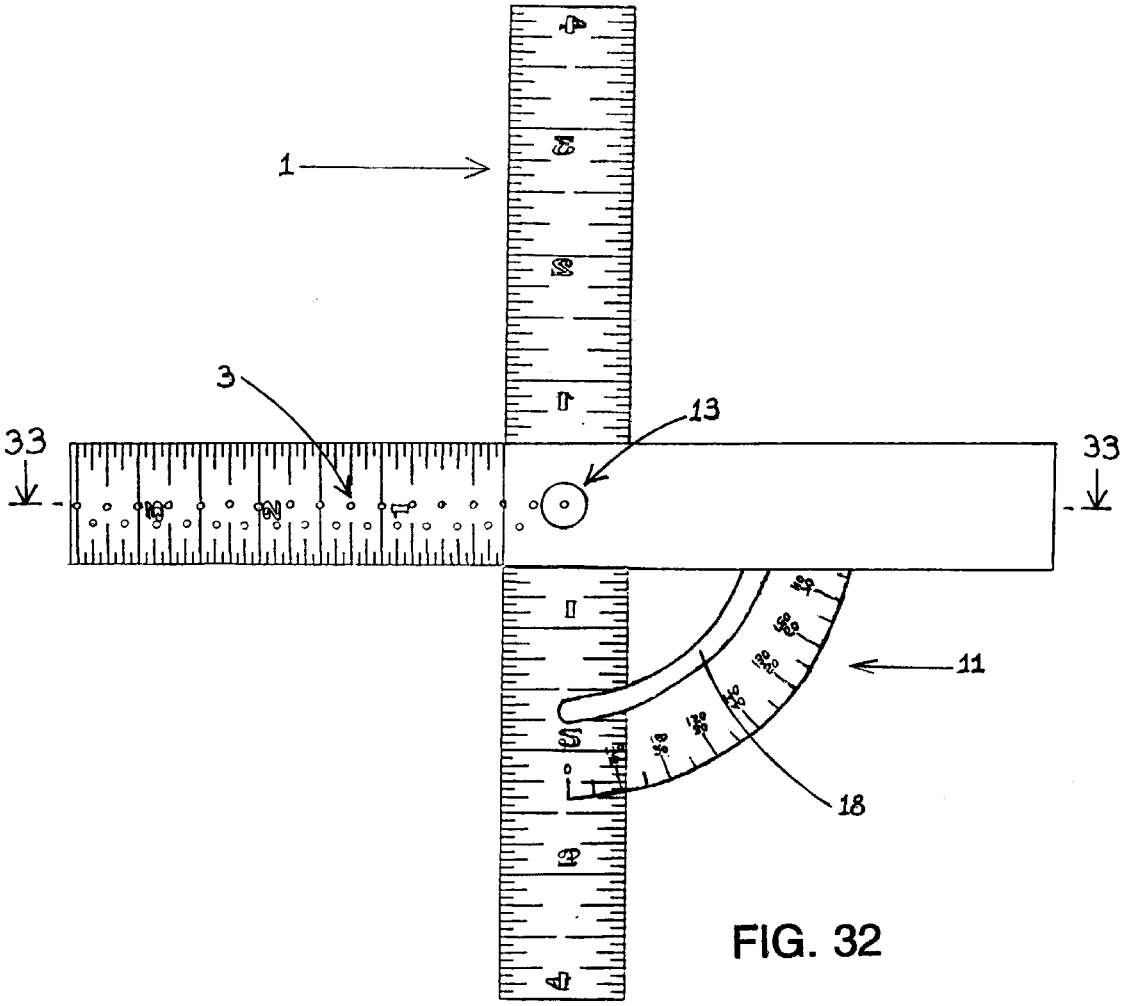
FIG. 32 shows a bottom view of the Measuring Tool shown in FIG. 31, and showing the calibrations on the bottom of one ruler segment (1) starting at the edge line (5) of the top ruler segment (1), rather than the center hole (2), when the adjacent ruler segments (1) of the Measuring Tool are at 90-degrees to each other.
Figure 33:
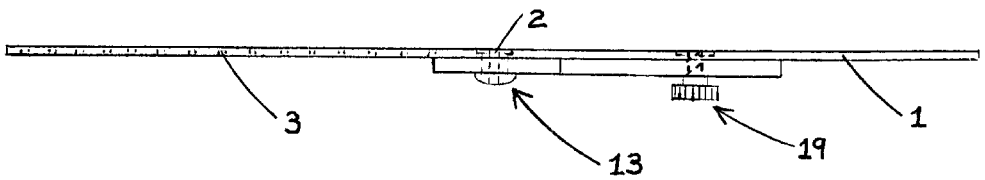
FIG. 33 shows a sectional side view of said Measuring Tool with a centrally located pivot (13), the section lines taken along lines 33—33 shown in FIG. 31.
Figure 34:
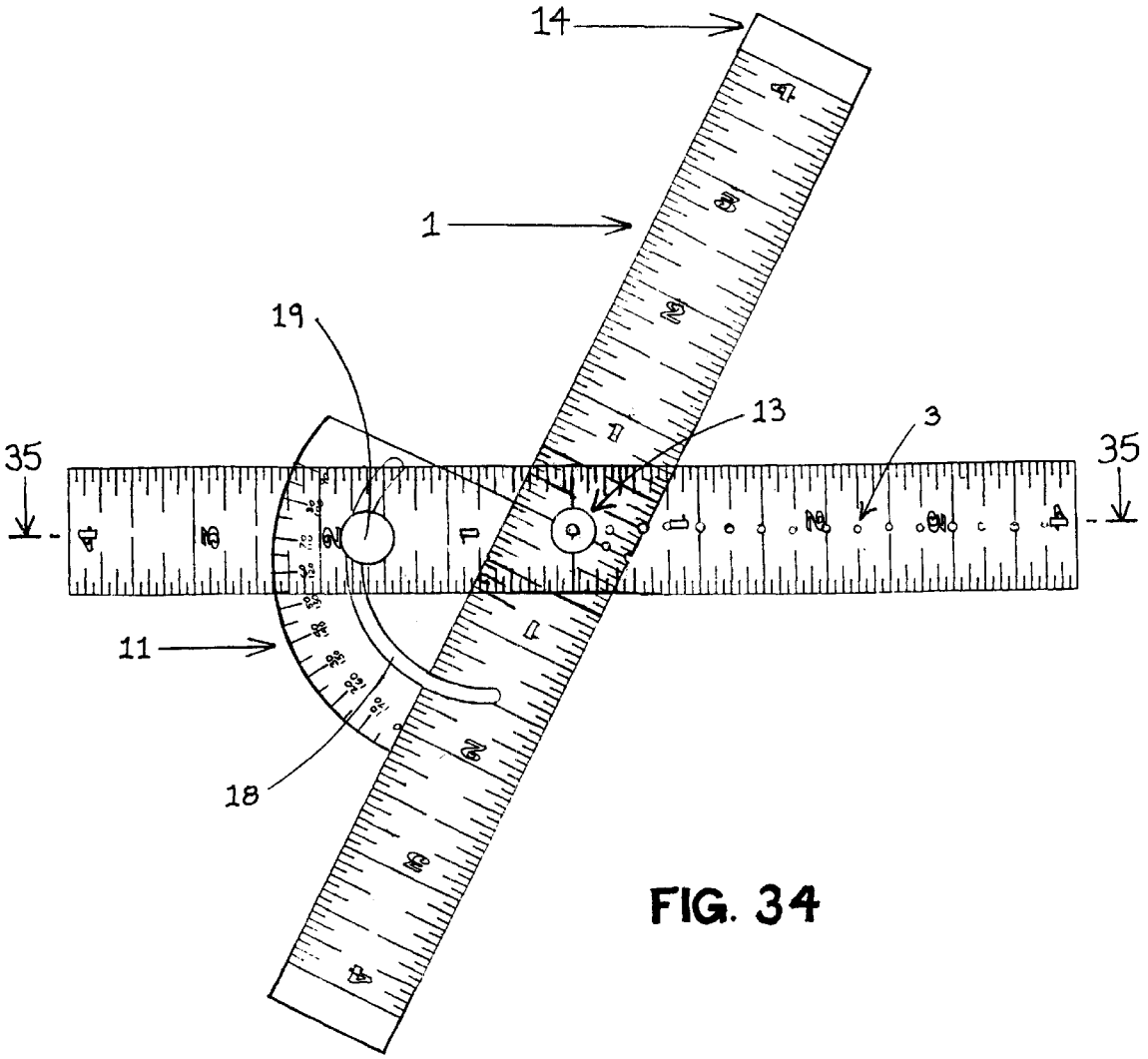
FIG. 34 shows a top view of the Measuring Tool similar to the embodiment shown in FIGS. 27–30, and is shown pivoted to an angle other than 90-degrees, and showing the two guide holes (3) located on said clear top ruler segment (1) are now not aligned with the guide holes (3) of the lower ruler segment (1), and further comprised of stability feet (14) located on each terminal end of the top element of the Measuring Tool, comprising the two top ruler segments (1).
Figure 35:
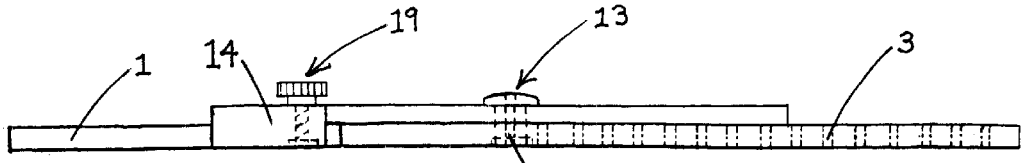
FIG. 35 shows a sectional side view of said Measuring Tool with a centrally located pivot (13) and two stability feet (14), the section lines 35—35 shown in FIG. 34.

Another Pivoting Measuring Tool with Protractor and Dual Guide Hole Sets would be comprised essentially of the Pivoting Measuring Tool with Protractor, as described above, and shown in FIGS. 27 through 30, but the bottom one piece ruler segments (1) would be essentially composed of a thin metal or alloy, such as stainless steel. This embodiment would also have two sets of parallel and offset guide holes (3), with a preferred embodiment having the guide holes (3) of each parallel set being 0.25 inch apart, and such that the guide holes (3) from each opposing set being 0.125 inch apart. The calibrations on the bottom ruler segment (1) with guide holes (3), would be starting from the edge line (5), rather than the center hole (2), as is the case with the other Pivoting embodiments of the Measuring Tool. This Pivoting Measuring Tool with Protractor and Dual Guide Hole Sets is shown in FIGS. 31 and 32.

DESCRIPTION OF ADDITIONAL EMBODIMENTS OF THE MEASURING TOOL

The Measuring Tool may be composed essentially of wood, cardboard, glass, metal or alloy, a polymeric material such as plastic, an elastomeric material such as rubber, or a combination thereof. A preferred embodiment of the Measuring Tool may be composed essentially of a durable, clear or transparent plastic, such as Lexan or acrylonitrilebutadiene-styrene ("ABS"). There is a significant advantage with embodiments of the Measuring Tool that are composed essentially of a transparent material, such as a transparent plastic, because the user may more easily view the surface(s) that they are measuring, and because it may be easier to make the desired measurements. The elastomeric embodiments of the Measuring Tool may also have an advantage of being flexible, but some compositions of rubber may have the disadvantage of distorting, thereby giving the user inaccurate measurements and unacceptable "straight edges". The alignment tabs (4) are attached or affixed to some embodiments of the Measuring Tool, using a super glue, or other adhesive means. Some embodiments of the Measuring Tool, may be molded or injection molded, thereby allowing the alignment to be molded and manufactured with the alignment tabs (4) in place on the Measuring Tool. The non-pivoting embodiments of the Measuring Tool are typically comprised of a one piece instrument or tool with ruler segments (1) separated by 90 degrees. The pivoting embodiments of the Measuring Tool are typically comprised of a two piece instrument or tool with each of the two non-adjacent ruler segments (1) comprising a separate piece, attached around the center hole (2) with a pivot (13) or the like, such as a grommet.

Figure 8:
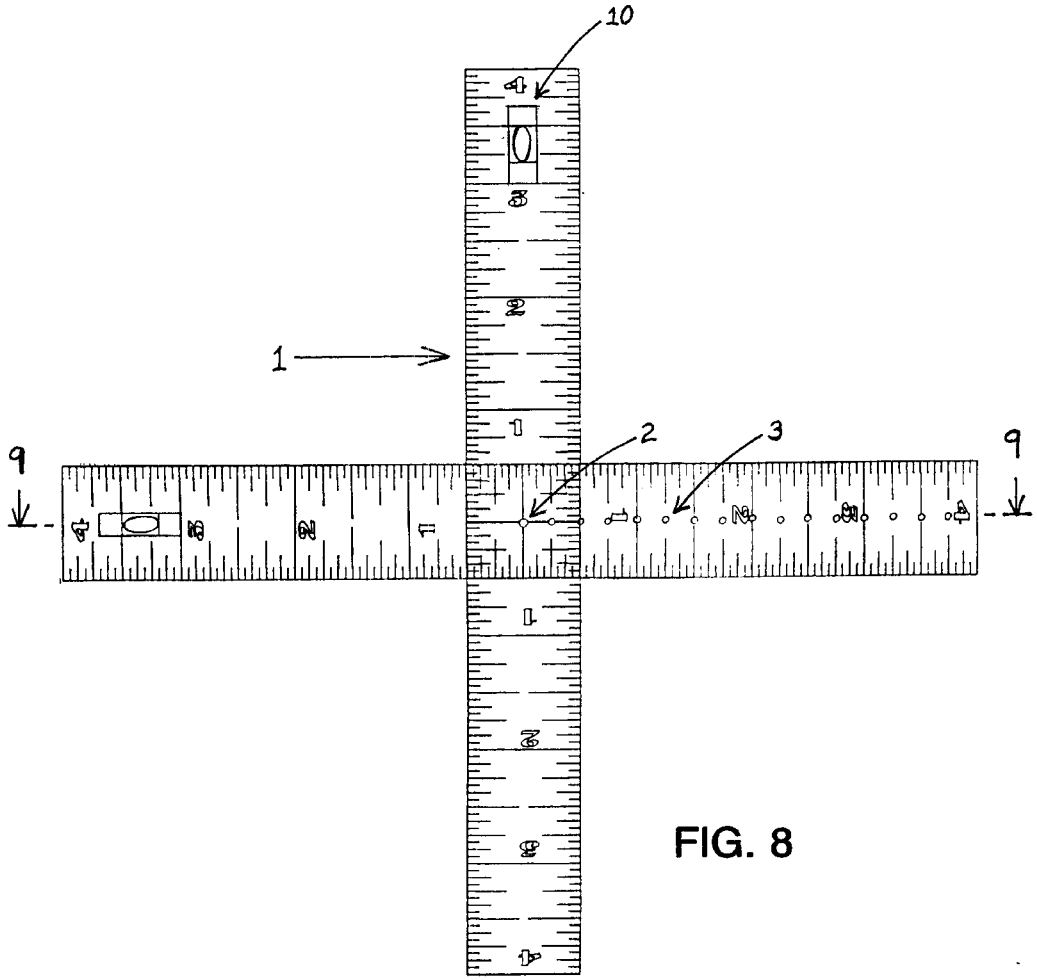
FIG. 8 shows a top view of an embodiment of the Measuring Tool with one bubble level (10) embedded in each of two adjacent ruler segments (1).
Figure 9:
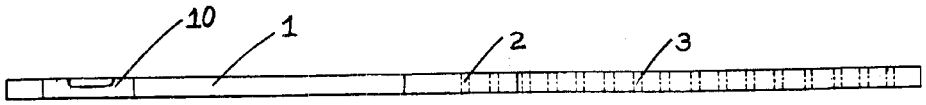
FIG.9 shows a sectional side view of said embodiment of the Measuring Tool with level capacity, and a bubble level (10) shown, the section lines taken along lines 9—9 shown in FIG. 8.

Some modified embodiments of the Measuring Tool may optionally include such additional features as a bubble level (10), located on one or more of the ruler segments (1), as shown, e.g., in FIGS. 8 and 9. Optionally these bubble levels (10) would be located near the terminal ends of two adjacent ruler segments (1).

Some modified embodiments of the Measuring Tool may optionally include such additional features as a hole or the like near the terminal end of a ruler segment (1) so that the Measuring Tool may easily be hung on a nail or a hook. Some other modified embodiments of the Measuring Tool may optionally include such additional features as decimal, or thousandths of an inch, measurements along the ruler segments, rather than English or metric measurements, or another variation of this modified embodiment may show English, decimal, and metric measuring units along the ruler segments.

While I have shown and described in this disclosure and its appended drawing figures, and which are a part of and incorporated in said disclosure, only selected embodiments in accordance with the present invention, it is understood that the same is not limited thereto, but is susceptible to numerous changes and modifications as known to one having skill in the art, and I therefore do not wish to be limited to the details shown and described herein, but intend to cover all such modifications, changes, eliminations, and hybrids, as are encompassed by the scope of the specification and the appended claims.

I claim:

1. A one-piece Measuring and Drafting Tool comprised essentially of:

a. four calibrated ruler segments, such that said four ruler segments are each extending along a common plane and each of the four calibrated ruler segments extends and measures from a common center hole that perforates said Measuring and Drafting Tool at the intersection of said four calibrated ruler segments, and such that each of the four calibrated ruler segments are perpendicular in said plane, to their adjacent ruler segments, and that calibrations on each of the four calibrated ruler segments originate from said common center hole;

b. a plurality of guide holes located on one of said four calibrated ruler segments;

c. a plurality of alignment tabs located on the top surface of two non-adjacent ruler segments, such that neither of said two non-adjacent ruler segments have guide holes located thereon, and such that an edge of each of the plurality of alignment tabs are in line with the common center hole.

2. A Measuring and Drafting Tool, as recited in claim 1, and further comprised essentially of a bubble level located on of two non-adjacent ruler segments.

3. A Measuring and Drafting Tool, as recited in claim 1, and further comprised essentially of a protractor located in said common plane and between two non-adjacent ruler segments that do not have said guide holes located thereon.

4. A Measuring and Drafting Tool, as recited in claim 1, and further comprised essentially of:

a. a protractor located in said common plane and between two non-adjacent ruler segments that do not have said guide holes located thereon; and b. a bubble level located on each of two adjacent ruler segments.

5. A Measuring and Drafting Tool, as recited in claim 1, and composed essentially of a clear polymeric material.

6. A two-piece Measuring and Drafting Tool comprised essentially of:

a. four ruler segments, such that two of said ruler segments are adjoined in a top plane and comprise a top element of said Measuring and Drafting Tool, and such that the remaining two ruler segments are adjoined in a bottom plane and comprise a bottom element of the Measuring and Drafting Tool, and said top element is parallel to said bottom element, and the top element is attached to the bottom element with a pivot means; and b. a stability foot located on the underside of each of two terminal ends of said top element of the Measuring and Drafting Tool.

7. A Measuring and Drafting Tool, as recited in claim 6, and further comprised essentially of a. a protractor with a protractor slot, said protractor with said protractor slot extends from an edge of one of the ruler segments located on said top element of said Measuring and Drafting Tool, and in the same plane as said ruler segment located on the top element; and b. a protractor tightening screw attached to one of the ruler segments located on said bottom element of the Measuring and Drafting Tool, and extending through the protractor slot, thereby also attaching the protractor to said ruler segment located on the bottom element.

8. A Measuring and Drafting Tool, as recited in claim 7, and further comprised of said top element of said Measuring and Drafting Tool composed essentially of an essentially clear polymeric material, and said bottom clement of the Measuring and Drafting Tool composed essentially of an alloy.

9. A Measuring and Drafting Tool, as recited in claim 6, and further comprised essentially of:

a. a protractor with a protractor slot, said protractor with said protractor slot extends from an edge of one of the ruler segments located on the top element of said Measuring and Drafting Tool, and in the same plane as said ruler segment located on said top element; and b. a protractor tightening screw attached to one of the ruler segments located on said bottom element of the Measuring and Drafting Tool, and extending through the protractor slot, thereby also attaching the protractor to said ruler segment located on the bottom element.

10. A Measuring and Drafting Tool, as recited in claim 9, and further comprised essentially of the top element of said Measuring and Drafting Tool composed essentially of an essentially clear polymeric material, and said bottom element of the Measuring and Drafting Tool composed essentially of an alloy.

11. A Measuring and Drafting Tool comprised essentially of:

a. four ruler segments extending from a common centrally located center hole;

b. a plurality of guide holes located on one of said four ruler segments;

c. each of the four ruler segments are perpendicular to their neighboring ruler segments; and d. a plurality of alignment tabs are located on the top surface of two non-adjacent ruler segments, such that neither of said two non-adjacent ruler segments has said guide holes located thereon.

12. A Measuring and Drafting Tool, as recited in claim 11, and further comprised essentially of a protractor located in a common plane between two non-adjacent ruler segments, and such that said two non-adjacent ruler segments do not have said guide holes located thereon.

13. A Measuring and Drafting Tool, as recited in claim 11, and further comprised essentially of:

a. the four ruler segments are comprised essentially of two sets of ruler segments with each said set of ruler segments located in one of two parallel planes, comprising a top plane and a bottom plane;

b. and such that said top plane and said bottom plane are attached together with a centrally located pivot surrounding said center hole, thereby allowing said two sets of ruler segments in said two parallel planes, to rotate around a central axis for each of the parallel planes, said central axis being said pivot surrounding the center hole.

14. A Measuring and Drafting Tool, as recited in claim 13, and further comprised essentially of a protractor with a protractor slot, extending from the edge of one ruler segment in the top plane, and extending to a protractor tightening screw attached to the bottom plane, such that said protractor tightening screw is passing through said protractor slot, thereby attaching said protractor with the protractor slot to said bottom plane of said Measuring and Drafting Tool.

15. A Measuring and Drafting Tool, as recited in claim 14, and composed essentially of a clear polymeric material.

* * * * *